US007450103B2

(12) United States Patent
Morita

(10) Patent No.: US 7,450,103 B2
(45) Date of Patent: Nov. 11, 2008

(54) DISPLAY DRIVER, ELECTRO-OPTICAL DEVICE, AND CONTROL METHOD FOR DISPLAY DRIVER

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 823 days.

(21) Appl. No.: 10/913,464

(22) Filed: Aug. 9, 2004

(65) Prior Publication Data

US 2005/0062734 A1 Mar. 24, 2005

(30) Foreign Application Priority Data

Sep. 10, 2003 (JP) ..... 2003-318082

(51) Int. Cl.
*G09G 3/36* (2006.01)

(52) U.S. Cl. ..... 345/100; 345/87; 345/211

(58) Field of Classification Search ..... 345/211, 345/87, 100

See application file for complete search history.

(56) References Cited

U.S. PATENT DOCUMENTS

| | | | | |
|---|---|---|---|---|
| 5,457,473 | A * | 10/1995 | Arai et al. | 345/10 |
| 5,926,155 | A | 7/1999 | Arai et al. | |
| 6,057,812 | A | 5/2000 | Arai et al. | |
| 6,078,301 | A | 6/2000 | Arai et al. | |
| 6,304,236 | B1 | 10/2001 | Arai et al. | |
| 6,346,930 | B2 | 2/2002 | Arai et al. | |
| 6,348,904 | B1 | 2/2002 | Arai et al. | |
| 6,639,588 | B2 | 10/2003 | Arai et al. | |
| 6,686,895 | B2 | 2/2004 | Arai et al. | |
| 6,778,169 | B1 * | 8/2004 | Hiraga et al. | 345/213 |
| 7,075,505 | B2 | 7/2006 | Sakaguchi et al. | |
| 2004/0061692 | A1 | 4/2004 | Arai et al. | |
| 2004/0196276 | A1 | 10/2004 | Arai et al. | |

FOREIGN PATENT DOCUMENTS

| | | |
|---|---|---|
| JP | A-05-061445 | 3/1993 |
| JP | A-05-232918 | 9/1993 |
| JP | A 2000-047628 | 2/2000 |
| JP | A 2000-148092 | 5/2000 |
| JP | A-2000-250526 | 9/2000 |
| JP | A 2001-174843 | 6/2001 |

OTHER PUBLICATIONS

U.S. Appl. No. 10/913,526, filed Aug. 9, 2004, Morita.
U.S. Appl. No. 10/912,247, filed Aug. 6, 2004, Morita.
U.S. Appl. No. 10/928,174, filed Aug. 30, 2004, Morita.

* cited by examiner

*Primary Examiner*—Kent Chang
(74) *Attorney, Agent, or Firm*—Oliff & Berridge, PLC

(57) ABSTRACT

A display driver includes: a data input section to which display data or command data is input; a display processing section which includes a data line driver section driving the data lines based on the display data input through the data input section; a control register for controlling the display processing section; a command signal generation section which generates a command signal which changes at a predetermined timing and is used to identify the command data; a command extraction section which extracts the command data from data such as the display data input through the data input section based on the command signal; and a decoder which decodes the command data extracted by the command extraction section. A value corresponding to a decoding result of the command data is set in the control register. The display processing section is controlled based on the value set in the control register.

13 Claims, 23 Drawing Sheets

DISPLAY DRIVER, ELECTRO-OPTICAL DEVICE, AND CONTROL METHOD FOR DISPLAY DRIVER

Japanese Patent Application No. 2003-318082, filed on Sep. 10, 2003, is hereby incorporated by reference in its entirety.

BACKGROUND OF THE INVENTION

The present invention relates to a display driver, an electro-optical device, and a control method for a display driver.

A display panel represented by an electro-optical panel includes a plurality of scan lines and a plurality of data line, and a pixel is specified by the scan line and the data line. The scan lines are sequentially selected by a scan driver. The data lines are driven by a data driver (display driver) based on display data. The scan driver and data driver are controlled by a display controller.

The data driver generally performs drive control corresponding to a command set by the display controller. Various technologies have been known relating to a data driver controlled by such a command setting.

For example, one data driver employs a configuration in which command address data is input as one piece of data and command data and display data are input as other pieces of data. A part of the address designated by the command address data is assigned to the display data, and the remaining address is assigned to the command data. This increases the amount of command data in comparison with the case where higher-order and lower-order addresses are respectively assigned to the command address data and the command data, for example. In this case, since it suffices to merely identify the command data and the display data, a change in hardware such as a change in the number of input terminals can be made unnecessary.

BRIEF SUMMARY OF THE INVENTION

One aspect of the present invention relates to a display driver which drives a plurality of data lines of an electro-optical panel which includes a plurality of scan lines, the data lines, and a plurality of pixels, and the display driver includes:

a data input section to which display data or command data is input;

a display processing section which includes a data line driver section which drives the data lines based on the display data input through the data input section;

a control register which is used for controlling the display processing section;

a command signal generation section which generates a command signal which changes at a predetermined timing and is used to identify the command data;

a command extraction section which extracts the command data from data including the display data or the command data input through the data input section based on the command signal; and a decoder which decodes the command data extracted by the command extraction section, wherein a value corresponding to a decoding result of the command data is set in the control register, and wherein the display processing section is controlled based on the value set in the control register.

An electro optical device according to another aspect of the present invention includes:

a plurality of scan lines;

a plurality of data lines;

a plurality of pixels; and the above display driver which drives the data lines.

A further aspect of the present invention relates to a control method for a display driver which drives a plurality of data lines of an electro-optical panel which includes a plurality of scan lines, the data lines, and a plurality of pixels, the control method includes:

generating a command signal which changes at a predetermined timing and is used to identify command data;

extracting the command data from display data or command data input through a data input section based on the command signal;

setting a value corresponding to a decoding result of the extracted command data in a control register; and controlling a display processing section which includes a data line driver section, which drives the data lines based on the display data input through the data input section, based on the value set in the control register.

DETAILED DESCRIPTION OF THE EMBODIMENT

Figure 1:
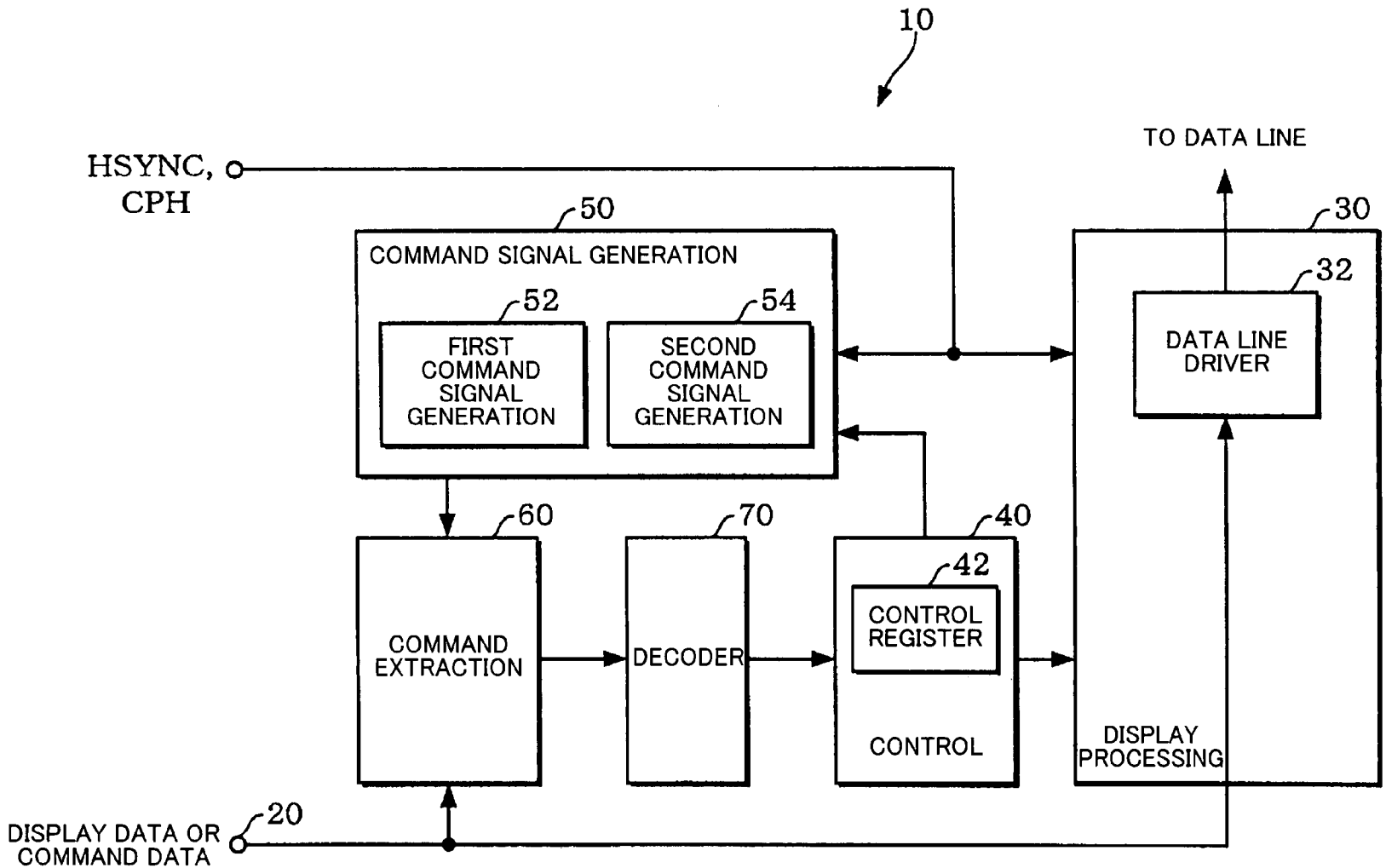
FIG. 1 is a block diagram schematically showing a configuration of a display driver in an embodiment of the present invention.

The embodiments of the present invention are described below with reference to the drawings. Note that the embodiments described hereunder do not in any way limit the scope of the invention defined by the claims laid out herein. Note also that not all of the elements of these embodiments should be taken as essential requirements to the present invention.

An increase in the number of functions of a display driver has progressed. The number of data lines of an electro-optical device has been significantly increased accompanying an increase in the display size of a display panel. Therefore, since the number of terminals of the display driver for driving data lines is significantly increased, it is difficult to further increase the number of other terminals. An increase in the number of terminals increases the chip size, thereby increasing cost. Moreover, since an input buffer or an input/output buffer connected with the terminal consumes a large amount of power, an increase in the number of terminals increases power consumption. Therefore, it is desirable that the number of terminals of the display driver be as small as possible.

However, an input terminal for a signal for identifying the command data or the display data is necessary for the above-described data driver. Therefore, the chip size and power consumption cannot be further reduced.

According to the following embodiments, a display driver controlled by command data while reducing the number of input terminals, an electro-optical device, and a control method for a display driver can be provided.

One embodiment of the present invention relates to a display driver which drives a plurality of data lines of an electro-optical panel which includes a plurality of scan lines, the data lines, and a plurality of pixels, and the display driver includes:

a data input section to which display data or command data is input;

a display processing section which includes a data line driver section which drives the data lines based on the display data input through the data input section;

a control register which is used for controlling the display processing section;

a command signal generation section which generates a command signal which changes at a predetermined timing and is used to identify the command data;

a command extraction section which extracts the command data from data including the display data or the command data input through the data input section based on the command signal; and a decoder which decodes the command data extracted by the command extraction section, wherein a value corresponding to a decoding result of the command data is set in the control register, and wherein the display processing section is controlled based on the value set in the control register.

In this embodiment, the display data or the command data is input to the data input section. The command signal generation section generates the command signal which changes at a predetermined timing, and the command data is extracted from the data input through the data input section based on the command signal. The extracted command data is decoded by the decoder, and the decoding result is set in the control register. This makes it unnecessary to provide an input terminal for inputting the command signal from the outside. The display processing section can be controlled by the input of the command data through the data input section. As a result, the chip size and power consumption can be further reduced due to a decrease in the number of terminals while realizing control of the display processing section.

With this display driver, the command signal generation section may include:

a first command signal generation section which generates a first command signal which changes at a predetermined timing; and a second command signal generation section which generates a second command signal which changes based on a value set in the control register corresponding to a decoding result of first command data, the command signal generation section may output the first or second command signal as the command signal, the first command data may be command data extracted based on the first command signal output as the command signal, and the display processing section may be controlled based on a value set in the control register corresponding to a decoding result of the command data extracted based on the second command signal output as the command signal.

Since the command data can be extracted from the data input through the data input section based on the second command signal, the display processing section can be controlled during the display operation even if an input terminal for inputting the command signal is not provided.

With this display driver, the first command data may include command data which sets a select flag for selecting one of the first and second command signals in the control register, and the command signal generation section may output one of the first and second command signals as the command signal based on the select flag.

Since the command signal generation section may generate the first and second command signals and selectively output one of the first and second command signals based on the command data, the configuration of the command signal generation section can be simplified.

With this display driver, the first command data may include command data which designates a start position and an end position of next command data, and the second command signal generation section may generate the second command signal of which a logical level changes when a period corresponding to the start position of the next command data has elapsed based on a given timing and a period corresponding to the end position of the next command data has elapsed based on the given timing.

With this display driver, the first command data may include command data which designates a length of the display data, and the second command signal generation section may generate the second command signal of which a logical level changes when a period corresponding to the length of the display data has elapsed based on a given timing.

In the case where the display data and the command data are time-division multiplexed and input through the data input section, the command data can be correctly extracted during the display operation based on the second command signal.

An electro optical device according to another embodiment of the present invention includes: a plurality of scan lines; a plurality of data lines; a plurality of pixels; and any one of the above display drivers which drives the data lines.

According to this embodiment, the size and power consumption of the electro-optical device can be reduced.

A further embodiment of the present invention provides a control method for a display driver which drives a plurality of data lines of an electro-optical panel which includes a plurality of scan lines, the data lines, and a plurality of pixels, and the control method includes:

generating a command signal which changes at a predetermined timing and is used to identify command data;

extracting the command data from display data or command data input through a data input section based on the command signal;

setting a value corresponding to a decoding result of the extracted command data in a control register; and controlling a display processing section which includes a data line driver section, which drives the data lines based on the display data input through the data input section, based on the value set in the control register.

This control method may includes:

generating a first command signal which changes at a predetermined timing;

extracting first command data from the display data or the command data input through the data input section based on the first command signal;

setting a value corresponding to a decoding result of the first command data in the control register;

generating a second command signal which changes based on the value set in the control register in which the value corresponding to the decoding result of the first command data is set;

extracting second command data from the display data or the command data input through the data input section based on the first command signal;

setting a value corresponding to a decoding result of the second command data in the control register; and controlling the display processing section based on the value set in the control register in which the value corresponding to the decoding result of the second command data is set.

The embodiments of the present invention are described below in detail with reference to the drawings.

1. Outline of Display Driver in Present Embodiment

FIG. 1 shows a block diagram schematically showing a configuration of a display driver in this embodiment.

A display driver 10 in this embodiment includes a data input section 20, a display processing section 30, a control section 40, a command signal generation section 50, a command extraction section 60, and a decoder 70.

Display data or command data is input to the data input section 20. The data input to the data input section 20 includes time-division multiplexed display data and command data. The function of the data input section 20 is realized by a data input terminal or a data input terminal and an input buffer (input/output buffer) connected with the data input terminal.

The display processing section 30 performs display processing of driving a plurality of data lines of an electro-optical panel. The display processing section 30 includes a data line driver section 32 which drives the data lines based on the display data input through the data input section 20.

The control section 40 controls the display processing section 30 including the data line driver section 32. The control section 40 includes a control register 42. The control section 40 controls the display processing section 30 based on a control signal corresponding to the value set in the control register 42. The control section 40 also controls the command signal generation section 50 based on the control signal corresponding to the value set in the control register 42.

The command signal generation section 50 generates a command signal for identifying the command data from the data input through the data input section 20. In more detail, the command signal generation section 50 generates the command signal which changes at a predetermined timing (first command signal). In more detail, the command signal generation section 50 generates the command signal which becomes active (H level, for example) in a predetermined period. When the command signal is set at the H level, the data input through the data input section 20 is identified as the command data. When the command signal is set at the L level, the data input through the data input section 20 is identified as the display data.

The command extraction section 60 extracts the command data from the data input through the data input section 20 based on the command signal. Specifically, the command signal generation section 50 fetches the data input through the data input section 20 as the command data when the command signal is set at the H level. A plurality of pieces of command data input when the command signal is set at the H level can be sequentially fetched by allowing the command data length to be fixed.

The decoder 70 decodes the command data extracted by the command extraction section 60. A value corresponding to the decoding result of the decoder 70 is set in the control register 42. The display processing section 30 is controlled based on the value set in the control register 42. The control register 42 includes a plurality of registers for generating different control signals. A value corresponding to the decoding result of the decoder 70 is set in the register corresponding to the decoding result of the decoder 70. The control signal is generated corresponding to the register and the value set in the register.

As described above, the command signal generation section 50 generates the command signal at a predetermined timing. This enables the display data and the command data to be input through the data input section 20 in a multiplexed state, and an input terminal for inputting the command signal from the outside to be omitted, whereby the number of terminals can be reduced.

It is preferable that the timing at which the command signal generation section 50 generates the command signal be within a period other than the data line drive output period of the data line driver section 32. A display image may be disordered at timing in a period other than the drive output period due to control based on the received command data. The control becomes complicated if the display processing section 30 is controlled so that the display image is not disordered. In the case where the drive output period of the data line driver section is specified by an output enable signal OE at the L level, the command signal generation section 50 generates a command signal using a horizontal synchronization signal HSYNC and the output enable signal OE in a period in which the output enable signal OE is set at the H level after initialization (rising edge of reset signal, for example). The horizontal synchronization signal HSYNC is a signal which specifies one horizontal scanning period.

In the case where the display driver 10 fetches the command data only at the above-described fixed timing, the setting content cannot be changed during the display operation. Therefore, in this embodiment, the reception timing of the next command data can be designated at the above-described timing. This enables the setting content to be changed by the command data during the display operation even if an input terminal for the command signal is omitted.

The command signal generation section 50 includes first and second command signal generation sections 52 and 54.

The first command signal generation section 52 generates a first command signal which changes at a predetermined timing. The first command signal is generated at the above-described fixed timing. The second command signal generation section 54 generates a second command signal. The second command signal changes based on the value set in the control register 42. The value set in the control register 42 is set corresponding to the decoding result of first command data extracted by the first command signal output as the command signal. The second command signal generation section 54 generates the second command signal based on the horizontal synchronization signal HSYNC and the dot clock signal CPH, for example. The display data input to the data input section 20 is input in synchronization with the dot clock signal CPH.

The command signal generation section 50 outputs the first or second command signal as the command signal. In more detail, the command signal generation section 50 outputs one of the first and second command signals as the command signal based on the value set in the control register 42. Specifically, the first command data extracted by the first command signal output as the command signal includes command data which sets a select flag for selecting one of the first and second command signals in the control register 42, and the command signal generation section 50 outputs one of the first and second command signals as the command signal based on the select flag.

The display processing section 30 is controlled based on the value set in the control register 42. The value set in the control register 42 is a value corresponding to the decoding result of the command data extracted based on the second command signal output as the command signal.

Figure 2:
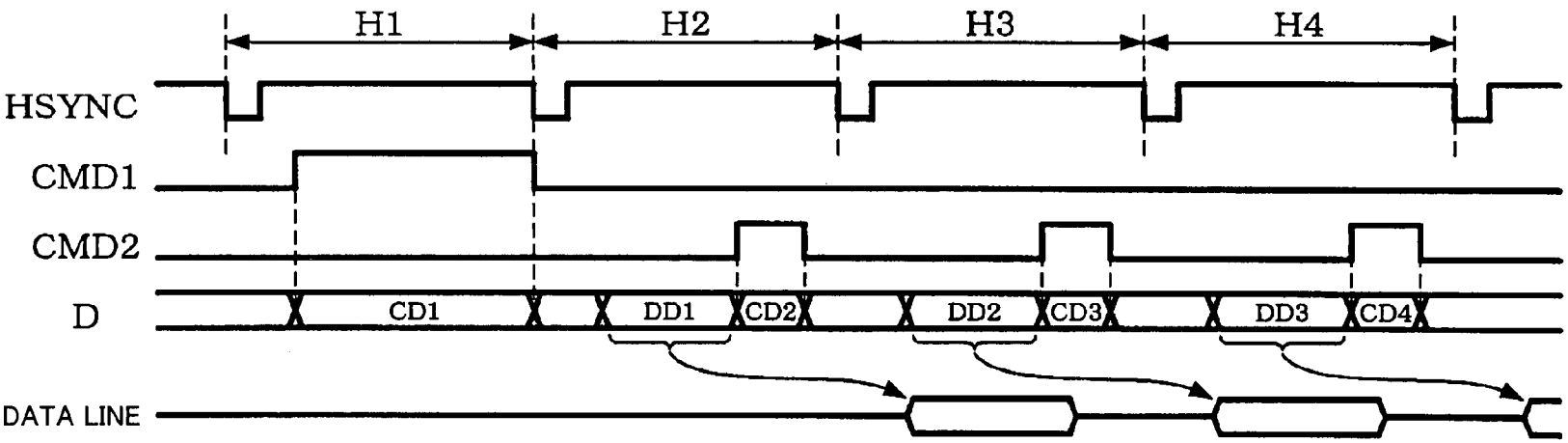
FIG. 2 shows an example of setting timing of a control register.

FIG. 2 shows an example of setting timing of the control register 42.

The display data or the command data is input as input data D through the data input section 20.

The first command signal generation section 52 generates a first command signal CMD1 which is set at the H level at a predetermined timing within a period in which the output enable signal is set at the H level after the rising edge of the reset signal, for example. The command signal generation section 50 outputs the first command signal CMD1 as the command signal in the initial state.

The command extraction section 60 extracts the input data D as first command data CD1 in a period in which the first command signal CMD1 output as the command signal is set at the H level. The decoder 70 decodes the first command data CD1. A value corresponding to the decoding result of the first command data CD1 is set in the control register 42 within the horizontal scanning period H1. The value set in the control register 42 within the horizontal scanning period H1 is used in the next horizontal scanning period H2. The first command data also includes command data which sets the select flag, and causes a second command signal CMD2 to be selected as the command signal in the next horizontal scanning period H2 by setting the select flag.

In the horizontal scanning period H2, the second command signal CMD2 generated by the second command signal generation section 54 is output as the command signal. The second command signal CMD2 is a signal of which the H level period is designated based on the first command data CD1.

The command extraction section 60 extracts the input data D as second command data CD2 in a period in which the second command signal CMD2 output as the command signal based on the select flag is set at the H level. The decoder 70 decodes the second command data CD2. A value corresponding to the decoding result of the second command data CD2 is set in the control register 42 within the horizontal scanning period H2.

In the next horizontal scanning period H3, the data line driver section 32 drives the data line based on display data DD1, which is the input data D input when the second command signal CMD2 is set at the L level in the horizontal scanning period H2. The display processing section 30 including the data line driver section 32 is controlled based on the value set in the control register 42 corresponding to the decoding result of the second command data CD2.

This enables the display processing section 30 to be controlled after the next horizontal scanning period H4 according to the command data extracted by the command signal designated in the horizontal scanning period immediately before the current horizontal scanning period.

FIG. 2 illustrates the case where the period in which the second command signal CMD2 is set at the H level is designated by the first command data CD1. However, the present invention is not limited thereto. The display processing section 30 may be controlled based on the value set in the control register 42 by the first command data CD1.

2. Configuration Example

A configuration example in which the display driver in this embodiment is applied as a data driver is described below.

Figure 3:
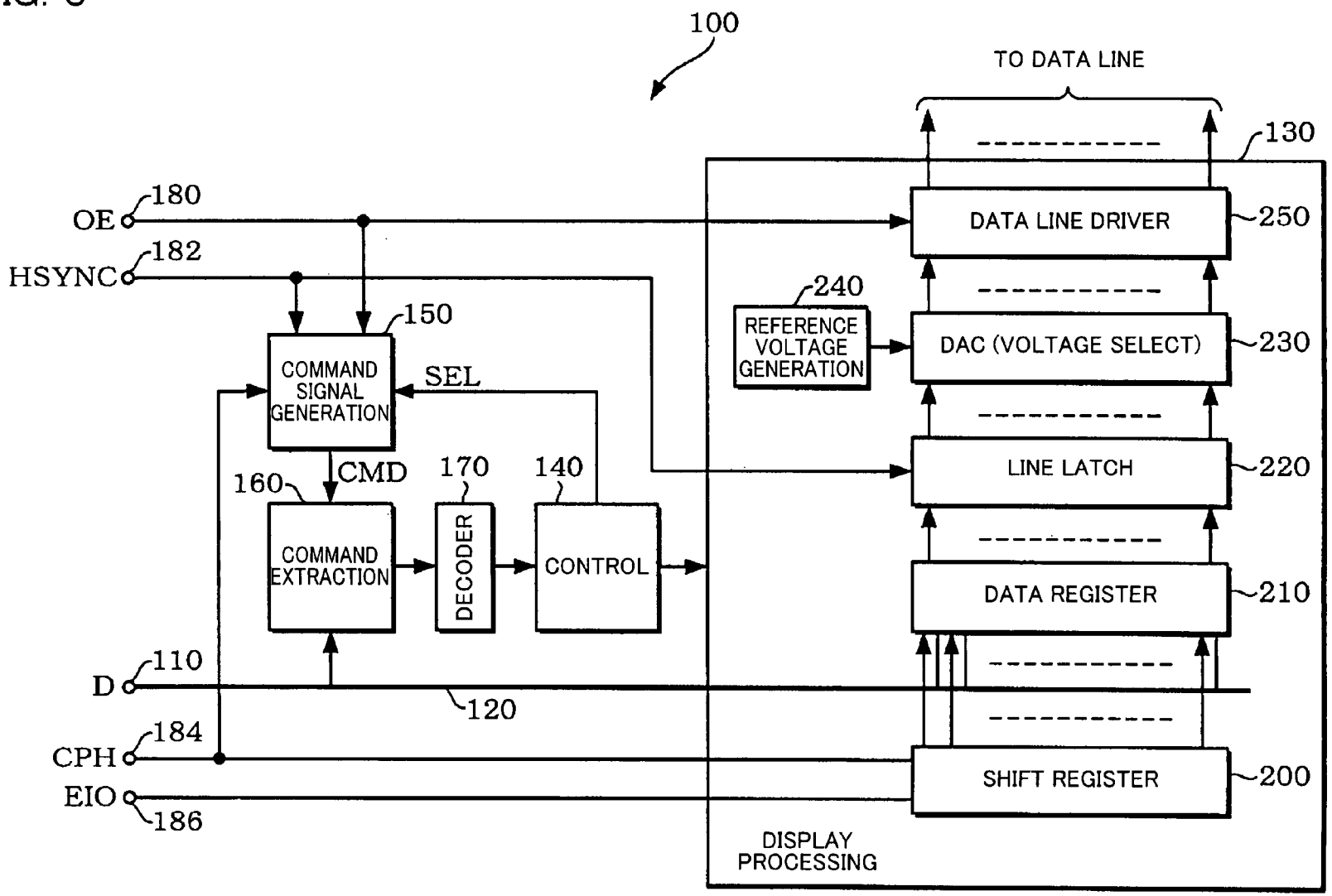
FIG. 3 is a block diagram of a configuration example of a data driver in an embodiment of the present invention.

FIG. 3 shows a block diagram of a configuration example of a data driver in this embodiment. In FIG. 3, sections the same as the sections of the display driver 10 shown in FIG. 1 are denoted by the same symbols. Description of these sections is appropriately omitted.

A data driver 100 includes a data input section 110, an input data bus 120, a display processing section 130, a control section 140, a command signal generation section 150, a command extraction section 160, and a decoder 170. The data input section 110 corresponds to the data input section 20 shown in FIG. 1. The display processing section 130 corresponds to the display processing section 30 shown in FIG. 1. The control section 140 corresponds to the control section 40 shown in FIG. 1. The command signal generation section 150 corresponds to the command signal generation section 50 shown in FIG. 1. The command extraction section 160 corresponds to the command extraction section 160 shown in FIG. 1. The decoder 170 corresponds to the decoder 70 shown in FIG. 1.

The command signal generation section 150 generates a command signal CMD using the output enable signal OE, the horizontal synchronization signal HSYNC, and the dot clock signal CPH. In more detail, the command signal generation section 150 selectively outputs one of the first and second command signals CMD1 and CMD2 generated by using these signals as the command signal CMD based on a select signal SEL from the control section 140. The command extraction section 160 extracts the command data from the data on the input data bus 120 based on the command signal CMD. The decoder 170 decodes the command data extracted by the command extraction section 160. The control section 140 includes a control register in which a value corresponding to the decoding result of the decoder 170 is set, and controls the display processing section 130 using the control signal based on the value set in the control register. The control signal includes the select signal SEL.

The data driver 100 includes an output enable signal input terminal 180 to which the output enable signal OE is input, a horizontal synchronization signal input terminal 182 to which the horizontal synchronization signal HSYNC is input, a dot clock signal input terminal 184 to which the dot clock signal CPH is input, and an enable input/output signal input terminal 186 to which an enable input/output signal EIO is input. The output enable signal OE, the horizontal synchronization signal HSYNC, the display data, the command data, the dot clock signal CPH, and the enable input/output signal EIO are supplied from a display controller (not shown).

The display processing section 130 includes a shift register 200, a data latch 210, a line latch 220, a digital-to-analog converter (DAC) 230 (voltage select circuit in a broad sense), a reference voltage generation circuit 240, and a data line driver section 250.

The shift register 200 generates a shift output by shifting the enable input/output signal EIO input through the enable input/output signal input terminal 186 based on the dot clock signal CPH input through the dot clock signal input terminal 184. The data latch 210 fetches the data on the input data bus 120 as the display data based on the shift output from the shift register 200. The line latch 220 latches the display data fetched into the data latch 210 based on the horizontal synchronization signal HSYNC input through the horizontal synchronization signal input terminal 182. The reference voltage generation circuit 240 generates a plurality of reference voltages. Each reference voltage corresponds to a grayscale value for one output. The grayscale value is designated by the display data for one dot. The DAC 230 selects the reference voltage corresponding to the grayscale value from the reference voltages generated by the reference voltage generation circuit 240. The data line driver section 250 drives the data line using the reference voltage from the DAC 230 when the output enable signal OE input through the output enable signal input terminal 180 is set at the L level. The output of the data line driver section 250 is set in a high impedance state when the output enable signal OE input through the output enable signal input terminal 180 is set at the H level.

An example in which the display processing section 130 is controlled by the command data in this embodiment is described below. First, an example of the command data and the control register is described below.

Figure 4:
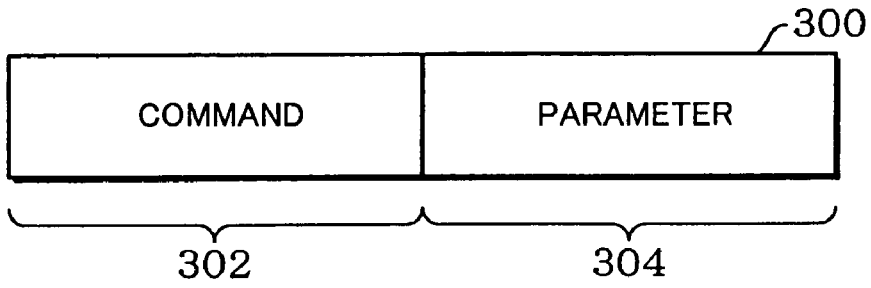
FIG. 4 shows a configuration example of command data in an embodiment of the present invention.

FIG. 4 shows a configuration example of the command data in this embodiment. Command data 300 includes a command section 302 and a parameter section 304. The command section 302 contains data which designates the control content. The control register is designated based on the value set in the command section 302. The parameter section 304 contains data set in the control register designated by the command section 302. The parameter section 304 is omitted depending on the type of command set in the command section 302. In this case, "0" is set in the parameter section 304, for example. The command data 300 has an 8-bit configuration, and the command section 302 and the parameter section 304 respectively have a 4-bit configuration, for example.

In this embodiment, the first command data is extracted from the display data or the command data input through the data input section 110 by the command signal (first command signal) which has been set at the H level at a predetermined timing. The identification timing of the next command data associated with the length of the display data is designated by the first command data (part of the first command data in more detail) taking the length of the display data into consideration.

Figure 5A:
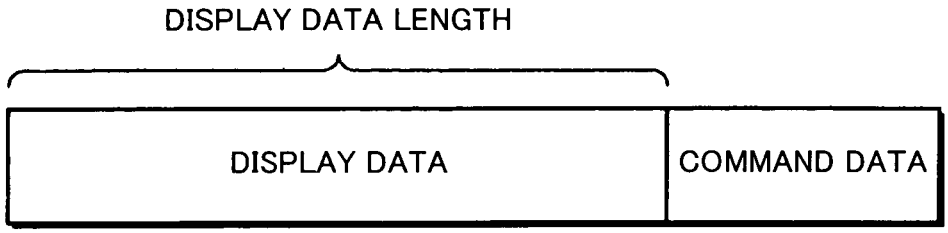
FIGS. 5A and 5B describe a designation method for identification timing of the next command data by first command data.
Figure 5B:
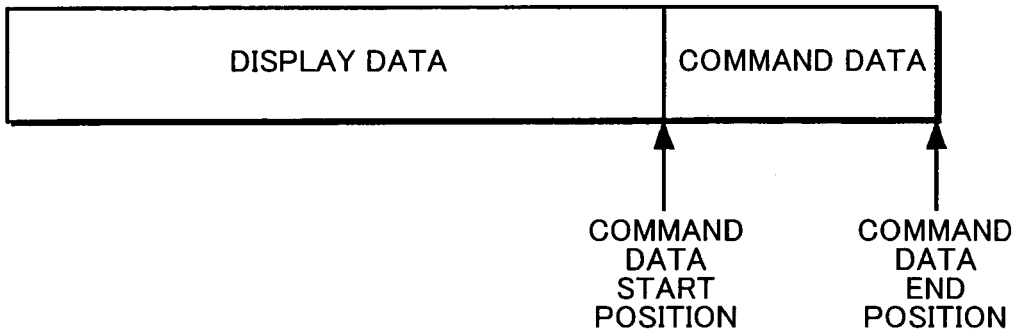

FIGS. 5A and 5B show explanatory diagrams of a designation method for the identification timing of the next command data by the first command data while taking the length of the display data into consideration.

FIG. 5A shows a configuration example of the input data input to the data input section 110 in units of one horizontal scanning period. The input data is data in which the display data and the command data are time-divided. Therefore, the range of the command data can be identified by designating the length of the display data. This is effective in the case where the length of the input data is recognized in advance.

FIG. 5B also shows a configuration example of the input data input to the data input section 110 in units of one horizontal scanning period. In this case, the range of the command data can be identified by designating the start position and the end position of the next command data. This is effective in the case where the input start timing of the input data or reference timing is recognized in advance. As the reference timing, the falling edge or the rising edge of the horizontal synchronization signal HSYNC can be given, for example. The next command data may be referred to as command data supplied from the display data in the next horizontal scanning period or the horizontal scanning period after the next horizontal scanning period, for example.

The following description illustrates the case where the identification timing of the command data is designated as shown in FIG. 5B.

Figure 6:
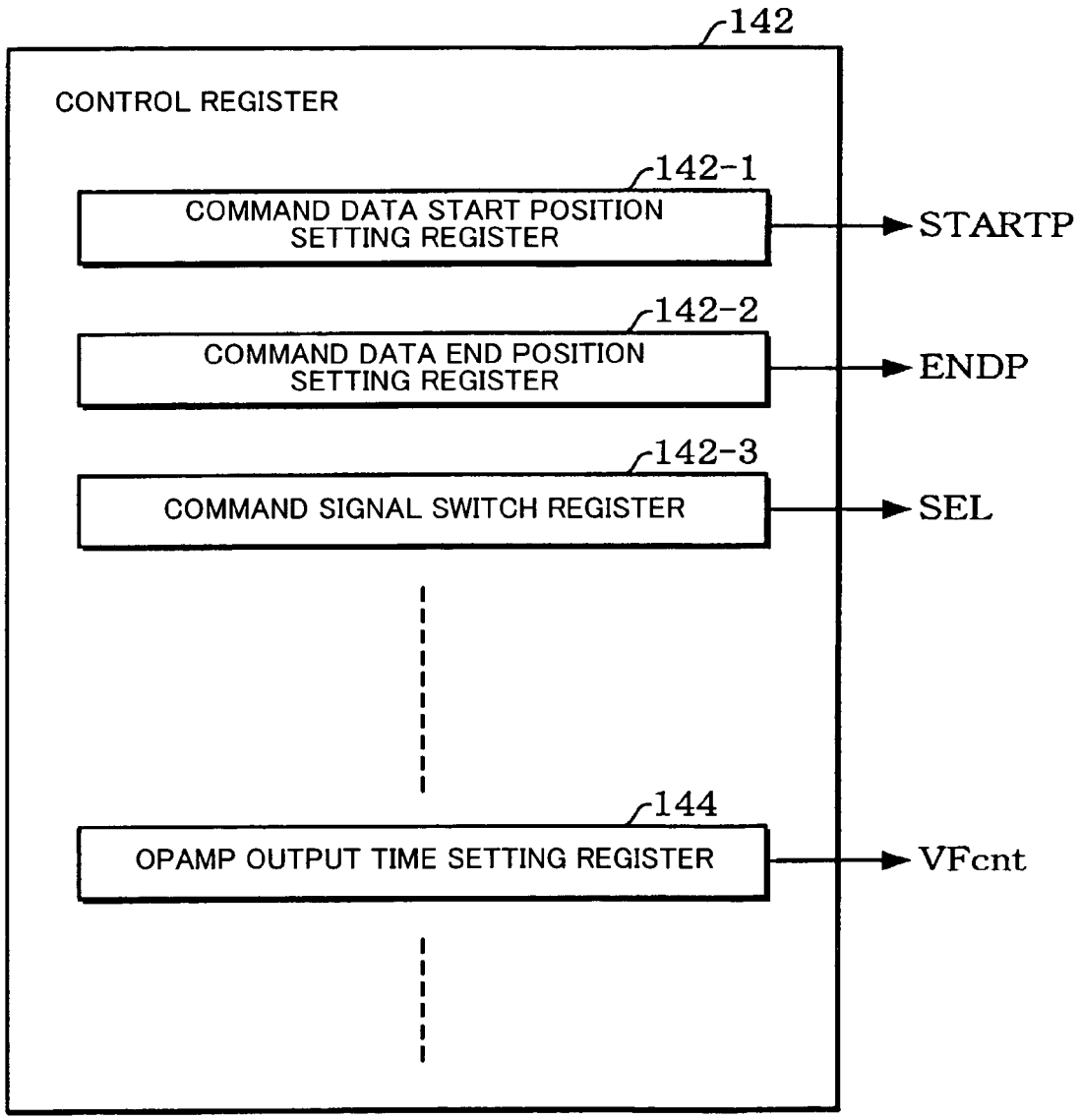
FIG. 6 shows a configuration example of a control register.

FIG. 6 shows a configuration example of a control register.

The control section 140 shown in FIG. 3 includes a control register 142. The control register 142 in this embodiment includes a command data start position setting register 142-1, a command data end position setting register 142-2, a command signal switch register 142-3 (select flag in a broad sense), and an OPAMP output time setting register 144.

One of the registers shown in FIG. 6 is designated by the content of the command section 302 of the command data 300 shown in FIG. 4. A value set in the designated register is designated by the content of the parameter section 304 of the command data 300 shown in FIG. 4.

Data for designating the start position of the command data shown in FIG. 5B is set in the command data start position setting register 142-1. A start position signal STARTP as control information is output based on this data. The start position of the command data may be designated by using the number of dot clock signals CPH based on the edge of the horizontal synchronization signal HSYNC, for example.

Data for designating the end position of the command data shown in FIG. 5B is set in the command data end position setting register 142-2. An end position signal ENDP as control information is output based on this data. The end position of the command data may be designated by using the number of dot clock signals CPH based on the edge of the horizontal synchronization signal HSYNC, for example.

A flag for selectively outputting one of the first and second command signals CMD1 and CMD2 from the command signal generation section 150 is set in the command signal switch register 142-3. The select signal SEL as a control signal is output based on the flag.

Data for designating the output time of an operational amplifier circuit included in the data line driver section 250 is set in the OPAMP output time setting register 144. An output time setting signal VFcnt as control information is output based on this data. Specifically, the display processing section 130 (data line driver section 250) is controlled based on the output time setting signal VFcnt.

A circuit configuration example of the command signal generation section 150, the command extraction section 160, the decoder 170, and the control register 142 which identify the command data for setting the control content in the control register 142 is described below. The following description is given on the assumption that the start position signal STARTP and the end position signal ENDP respectively consist of eight bits and the output time setting signal VFcnt consists of four bits. The command data is input in units of four bits.

Figure 7:
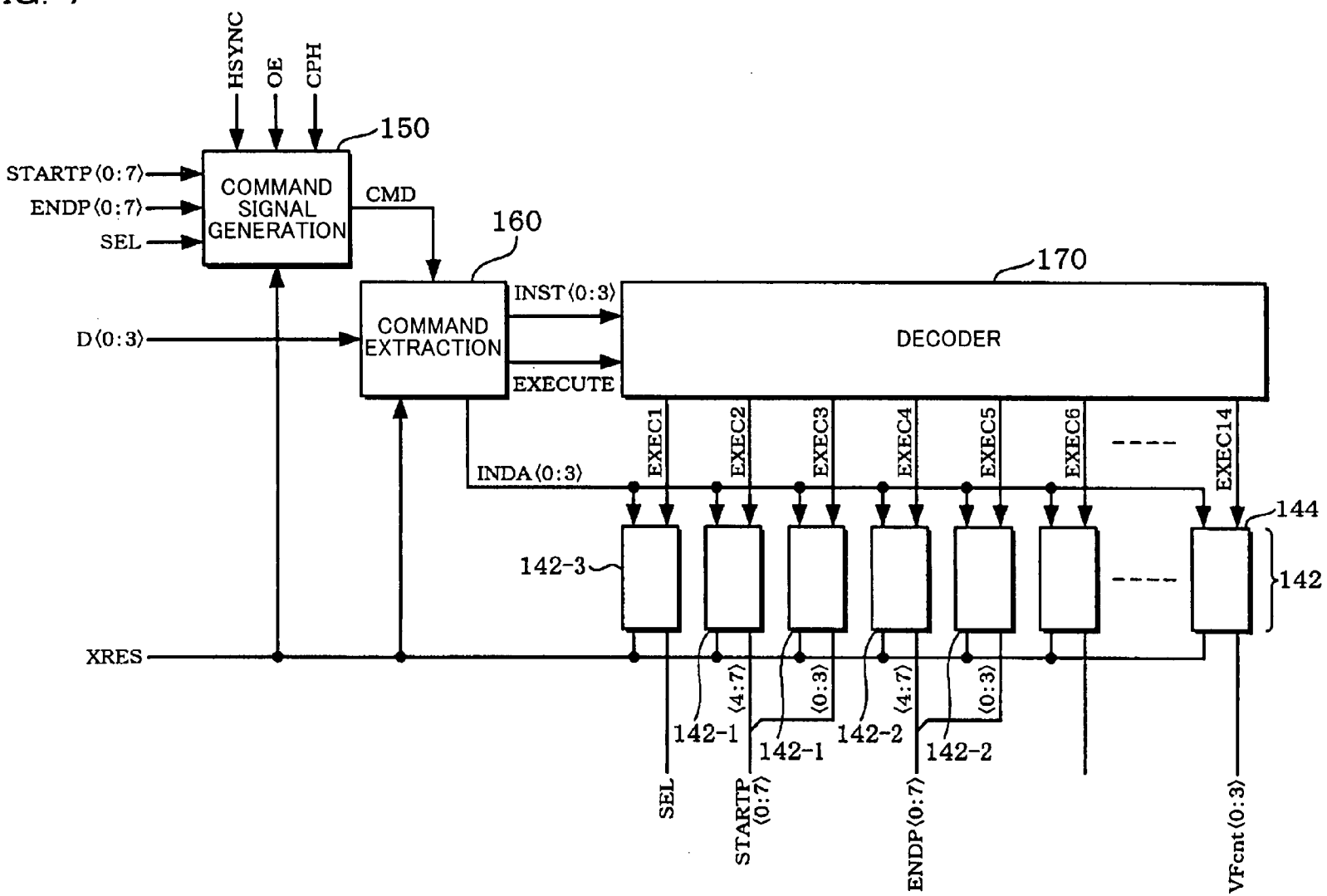
FIG. 7 shows a circuit configuration example of a command signal generation section, a command extraction section, a decoder, and a control register shown in FIG. 3.

FIG. 7 shows a diagram of a circuit configuration example of the command signal generation section 150, the command extraction section 160, the decoder 170, and the control register 142 shown in FIG. 3. In FIG. 7, the higher-order four bits and the lower-order four bits of each of the start position signal STARTP and the end position signal ENDP are designated by different pieces of command data.

The command signal generation section 150 generates the first and second command signals CMD1 and CMD2, and outputs one of the first and second command signals CMD1 and CMD2 to the command extraction section 160 as the command signal CMD based on the select signal SEL. The command extraction section 160 extracts the command data from the lower-order four bits D<0:3> of the input data bus. The command section 302 and the parameter section 304 as shown in FIG. 4, each having a 4-bit configuration, are alternately input. Therefore, the command extraction section 160 outputs the command section of the extracted command data to the decoder 170 as a command extraction signal INST<0:3>, and outputs the parameter section of the extracted command data to the control register 142 as a parameter extraction signal INDA<0:3>. The command extraction section 160 outputs a command execution instruction signal EXECUTE to the decoder 170.

The decoder 170 decodes the command extraction signal INST<0:3>, and changes write instruction signals EXEC1 to EXEC14 output to the control register 142 based on the execution instruction signal EXECUTE.

The value of the parameter extraction signal INDA<0:3> is set in each register of the control register 142 based on the write instruction signals EXEC1 to EXEC14.

Figure 8:
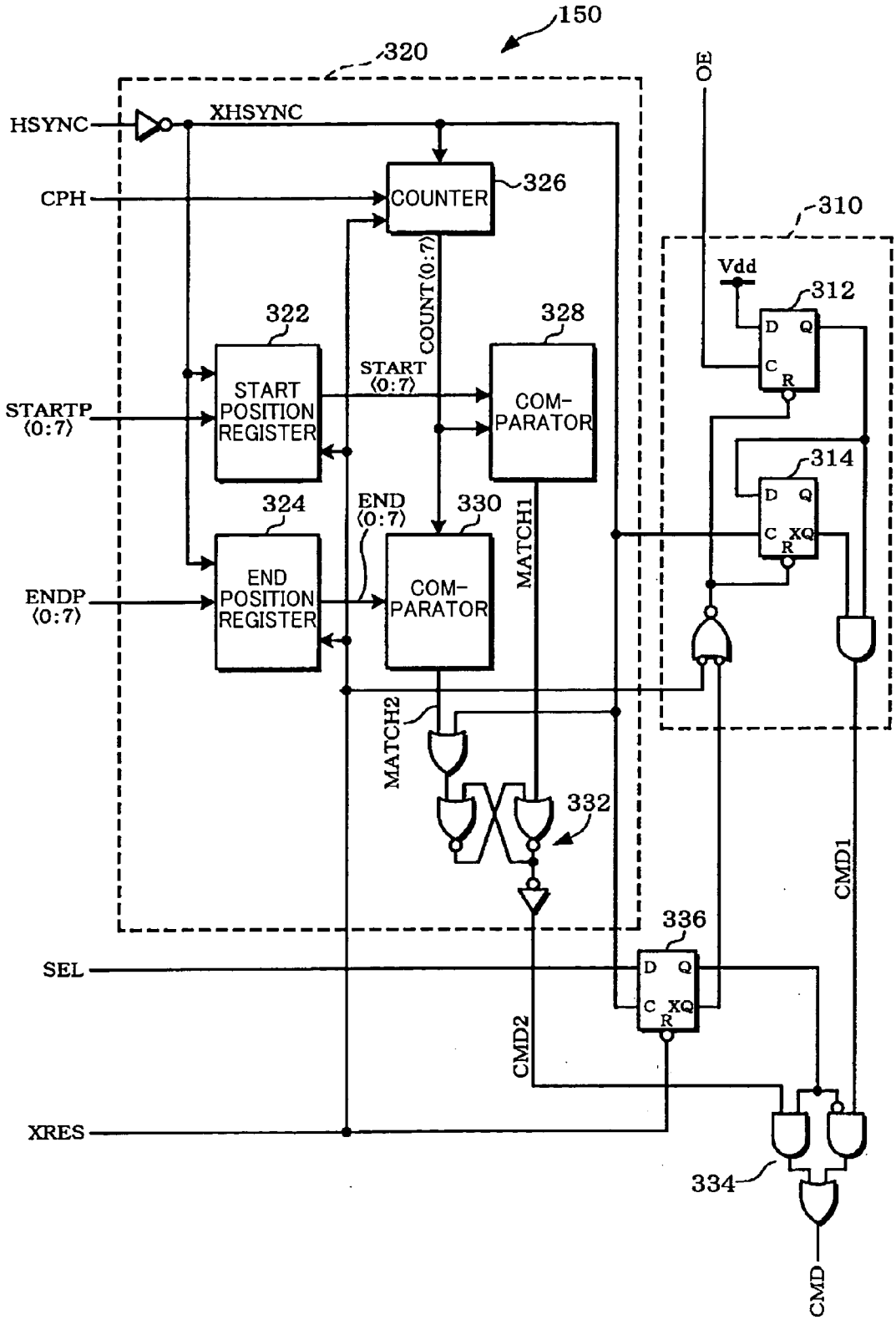
FIG. 8 shows a circuit configuration example of a command signal generation section.

FIG. 8 shows a circuit configuration example of the command signal generation section 150. The command signal generation section 150 includes first and second command signal generation sections 310 and 320.

The first command signal generation section 310 includes D flip-flops (DFF) 312 and 314. In this example, the D flip-flop retains the logical level of a signal input to a data input terminal D at the rising edge of a signal input to a clock input terminal C, and outputs an output signal at the retained logical level from a data output terminal Q. The D flip-flop is initialized when a signal input to a reset terminal R is set at the L level. In the case where the D flip-flop includes an inversion data output terminal XQ, an inversion signal of the output signal from the data output terminal Q is output from the inversion data output terminal XQ.

When the output enable signal OE rises to the H level from the L level, the output from the D flip-flop 312 is set at the H level. The D flip-flop 314 fetches the output from the D flip-flop 312 at the falling edge of the horizontal synchronization signal HSYNC. The first command signal CMD1 output as the AND operation result of the output from the D flip-flop 312 and the inversion output from the D flip-flop 314 is set at the H level in a period from the rising edge of the output enable signal OE to the falling edge of horizontal synchronization signal HSYNC. The D flip-flops 312 and 314 are initialized by an inversion signal of a signal generated by synchronizing the reset signal XRES which becomes active at the L level or the select signal SEL with the falling edge of the horizontal synchronization signal HSYNC.

The second command signal generation section 320 includes a start position register 322, an end position register 324, a counter 326, comparators 328 and 330, and an RS flip-flop (RSFF) 332.

Figure 9:
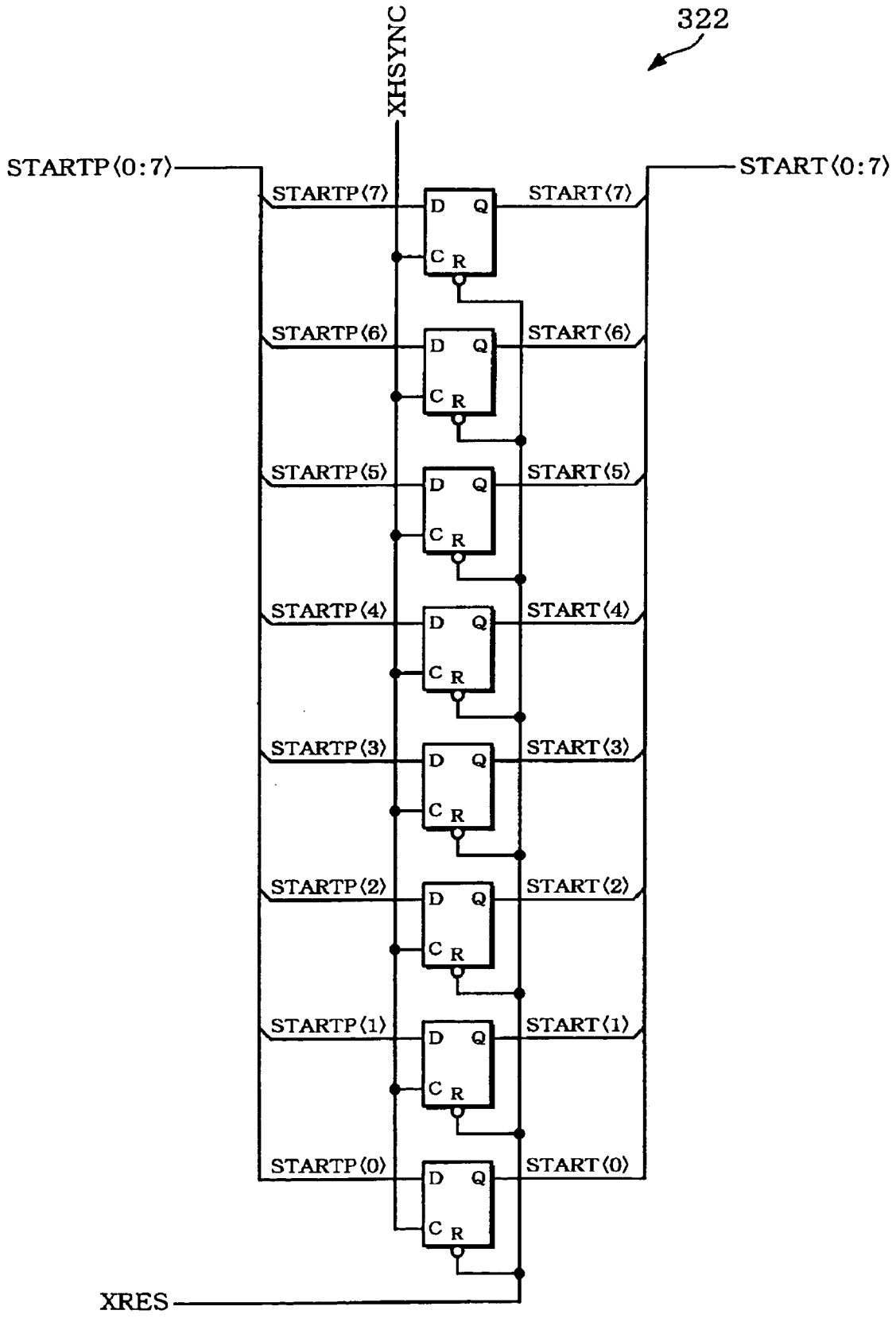
FIG. 9 shows a circuit configuration example of a start position register.

FIG. 9 shows a circuit configuration example of the start position register 322.

The start position register 322 outputs a start position synchronization signal START<0:7> generated by synchronizing the start position signal STARTP<0:7> with the rising edge of an inversion horizontal synchronization signal XHSYNC generated by reversing the horizontal synchronization signal HSYNC. The start position synchronization signal START<0:7> is supplied to the comparator 328.

The configuration of the end position register 324 is the same as that of the start position register 322 shown in FIG. 9. In the end position register 324, an end position signal ENDP<0:7> and an end position synchronization signal END<0:7> are respectively employed instead of the start position signal STARTP<0:7> and the start position synchronization signal START<0:7> shown in FIG. 9. The end position synchronization signal END<0:7> is supplied to the comparator 330. The value represented by the end position signal ENDP<0:7> is set to be greater than the value represented by the start position signal STARTP<0:7>.

Figure 10:
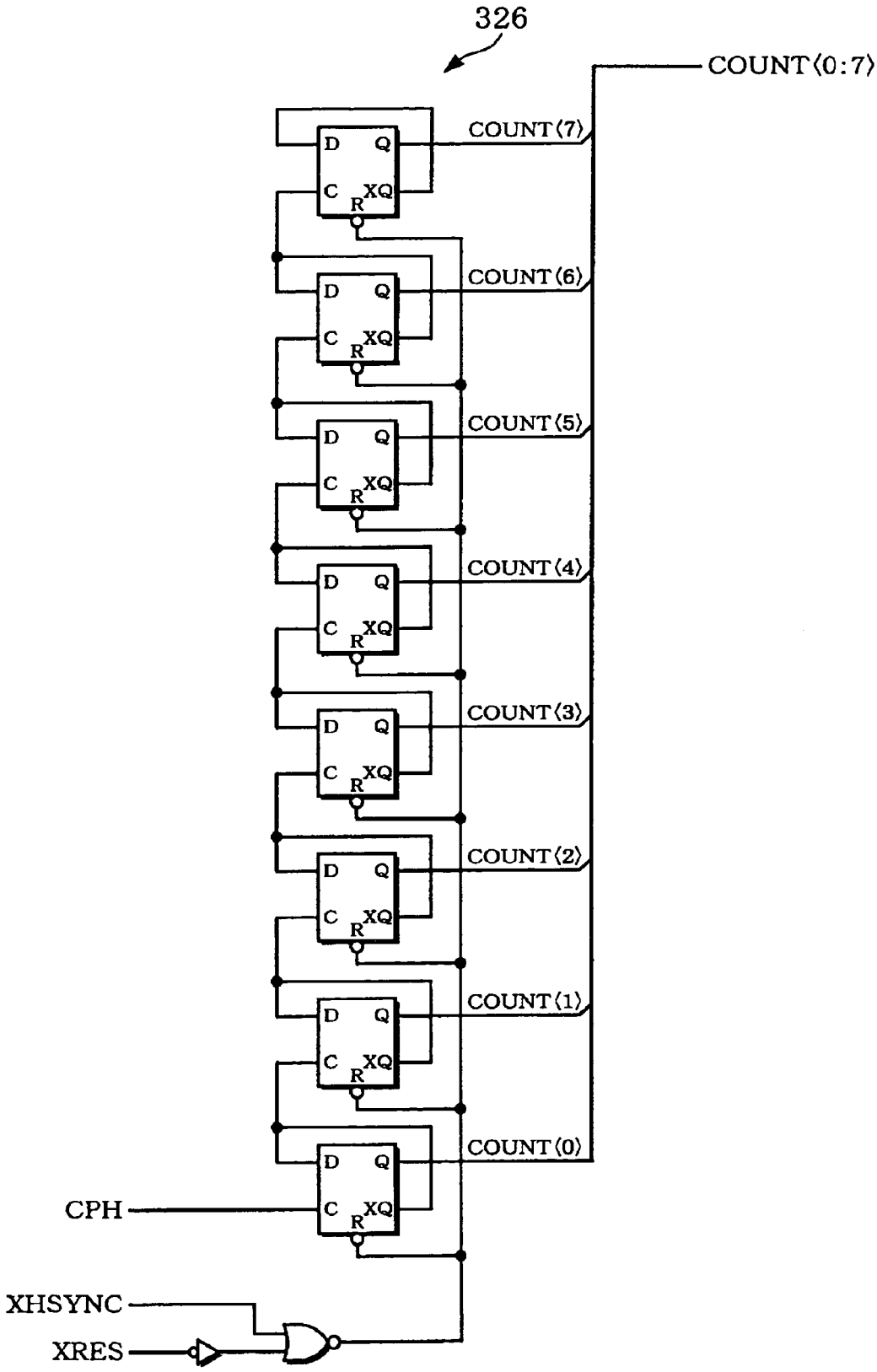
FIG. 10 shows a circuit configuration example of a counter.

FIG. 10 shows a circuit configuration example of the counter 326. The counter 326 is a ripple-carry counter formed by eight D flip-flops. The dot clock signal CPH is input to the D flip-flop in the first stage. The counter 326 performs a count operation in synchronization with the dot clock signal CPH, and outputs a counter value COUNT<0:7> to the comparators 328 and 330.

Figure 11:
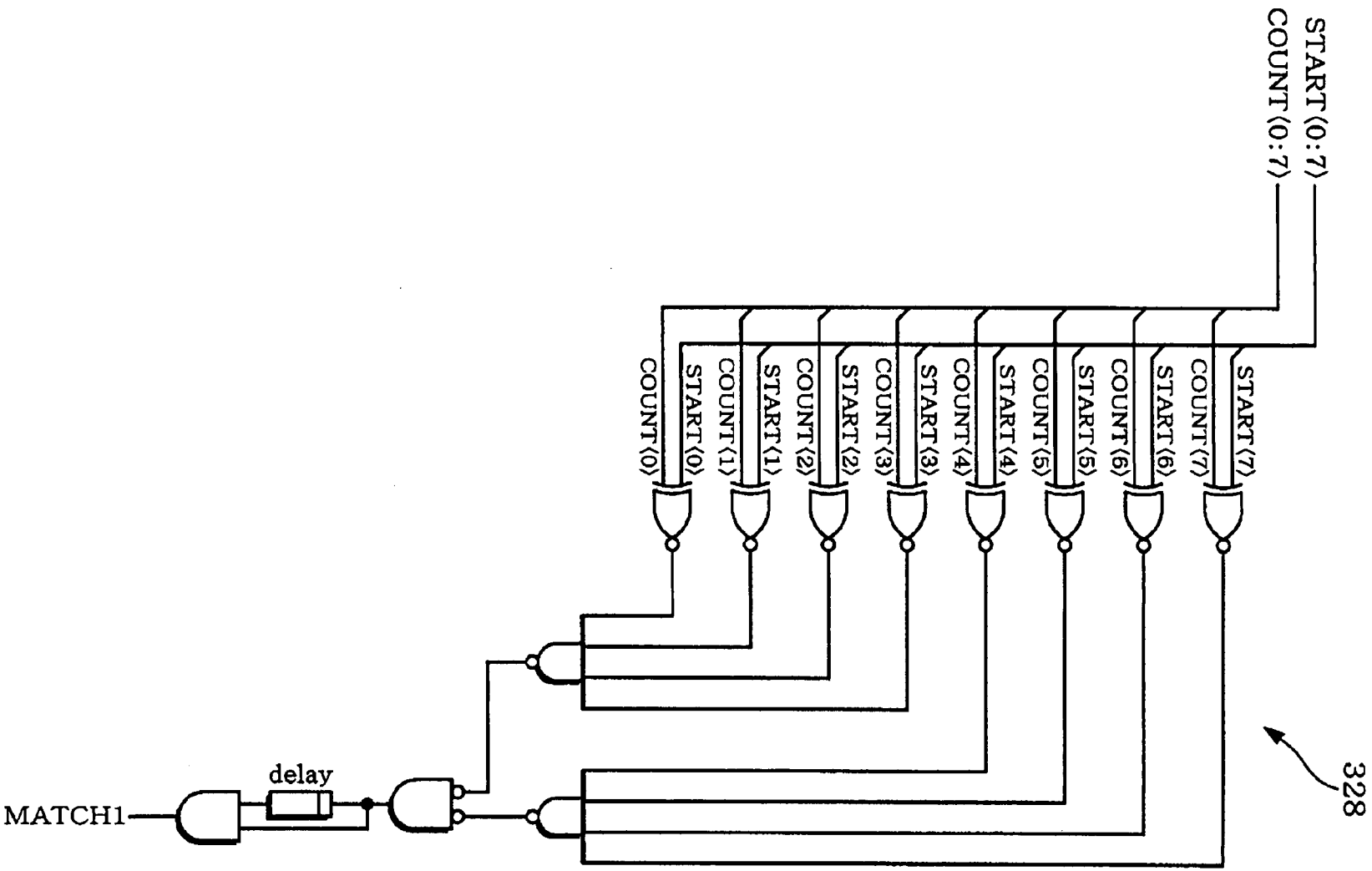
FIG. 11 shows a circuit configuration example of a comparator.

FIG. 11 shows a circuit configuration example of the comparator 328. The comparator 328 compares the start position synchronization signal START<0:7> with the counter value COUNT<0:7> in bit units. When all the eight bits coincide, the comparator 328 outputs a first coincidence detection signal MATCH1 to the RS flip-flop 332 as a pulse signal.

The comparator 328 includes eight exclusive NOR circuits which detect coincidence between each bit of the start position synchronization signal START<0:7> and each bit of the counter value COUNT<0:7>. A pulse having a pulse width for a delay time of a delay element is output as the first coincidence detection signal MATCH1 when a coincidence state in which each bit of the start position synchronization signal START<0:7> coincides with each bit of the counter value COUNT<0:7> is changed to a non-coincidence state.

The configuration of the comparator 330 is the same as that of the comparator 328 shown in FIG. 11. In the comparator 330, the end position synchronization signal END<0:7> and a second coincidence detection signal MATCH2 are respectively employed instead of the start position synchronization signal START<0:7> and the first coincidence detection signal MATCH1 shown in FIG. 11. The second coincidence detection signal MATCH2 is output to the RS flip-flop 332.

In FIG. 8, the RS flip-flop 332 generates the second command signal CMD2 based on the first and second coincidence detection signals MATCH1 and MATCH2 and the inversion horizontal synchronization signal XHSYNC. When the second coincidence detection signal MATCH2 or the inversion horizontal synchronization signal XHSYNC is set at the H level, the RS flip-flop 332 resets the second command signal CMD2 to the L level. When the first coincidence detection signal MATCH1 is set at the H level, the RSFF 332 sets the second command signal CMD2 at the H level.

The first and second command signals CMD1 and CMD2 are input to the selector 334 in this manner. The selector 334 is selected by the signal from the data output terminal Q of the D flip-flop 336. The D flip-flop 336 outputs a signal generated by synchronizing the select signal SEL with the rising edge of the inversion horizontal synchronization signal XHSYNC from the data output terminal Q. The first command signal CMD1 is output as the command signal CMD when the signal output from the data output terminal Q is set at the L level, and the second command signal CMD2 is output as the command signal CMD when the signal output from the data output terminal Q is set at the H level.

Figure 12:
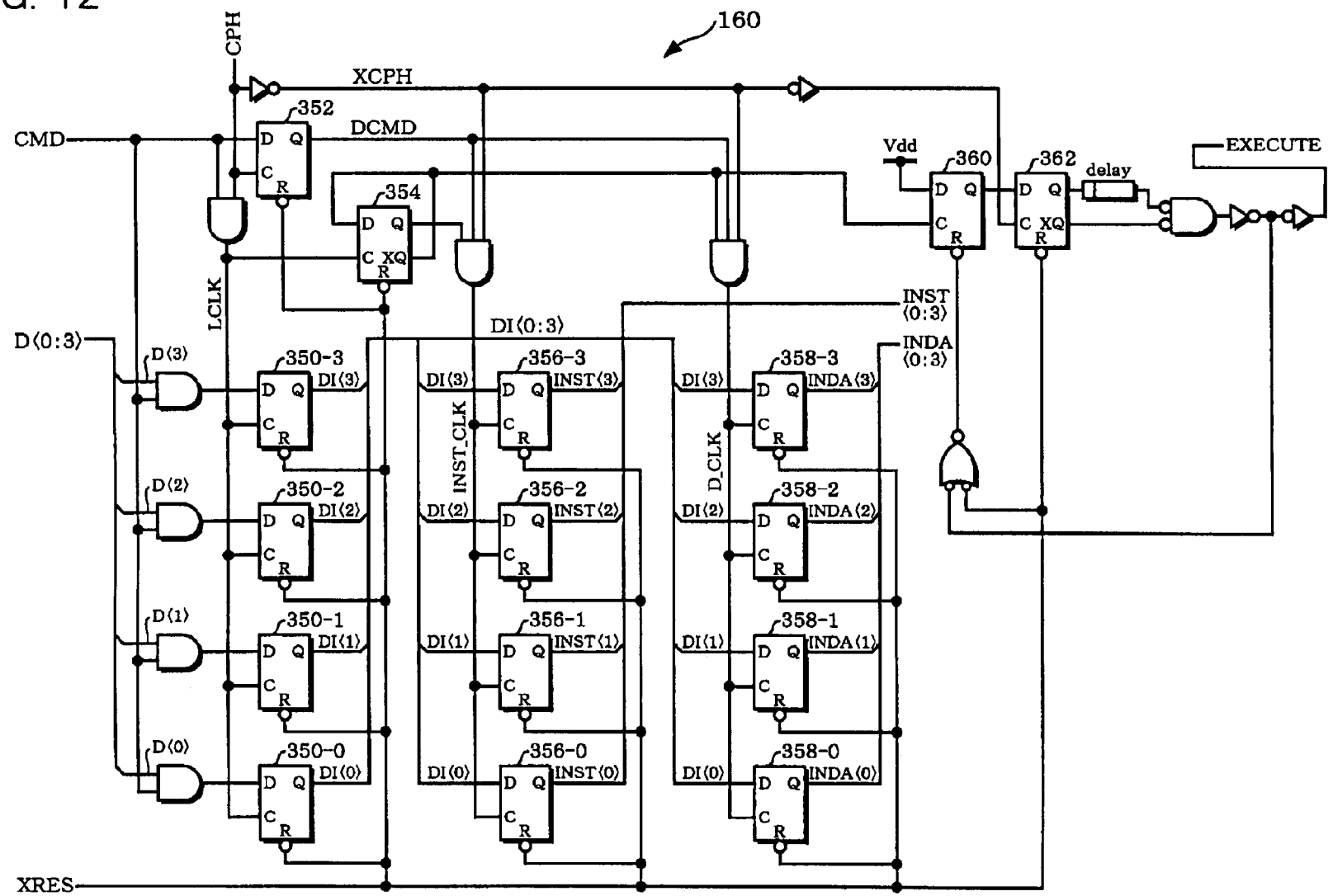
FIG. 12 shows a circuit configuration example of a command extraction section.

FIG. 12 shows a circuit configuration example of the command extraction section 160. The command extraction section 160 generates a latch clock signal LCLK, and extracts the command data on the input data bus 120 based on the latch clock signal LCLK. Therefore, the latch clock signal LCLK may be the AND operation result of the command signal CMD and the dot clock signal CPH. D flip-flops 350-0 to 350-3 of the command extraction section 160 fetch the data on the input data bus 120 which is enabled when the latch clock signal LCLK is set at the H level based on the latch clock signal LCLK. The D flip-flops 350-0 to 350-3 output input data DI<0:3>.

The command extraction section 160 generates a command clock signal INST_CLK, fetches the input data DI<0:3> based on the command clock signal INST_CLK, and outputs the input data DI<0:3> as a command extraction signal INST<0:3>. A D flip-flop 352 outputs a synchronization command signal DCMD generated by synchronizing the command signal CMD with the dot clock signal CPH. A D flip-flop 354 divides the frequency of the latch clock signal LCLK by two. The command clock signal INST_CLK is generated as the AND operation result of an inversion dot clock signal XCPH generated by reversing the dot clock signal CPH, the synchronization command signal DCMD, and a signal output from a data output terminal Q of the D flip-flop 354. D flip-flops 356-0 to 356-3 fetch the input data DI<0:3> based on the command clock signal INST_CLK, and output the input data DI<0:3> as the command extraction signal INST<0:3>.

The command extraction section 160 generates a parameter clock signal D_CLK, fetches the input data DI<0:3> based on the parameter clock signal D_CLK, and outputs the input data DI<0:3> as a parameter extraction signal INDA<0:3>. The parameter clock signal D_CLK is generated as the AND operation result of the inversion dot clock signal XCPH, the synchronization command signal DCMD, and a signal output from an inversion data output terminal XQ of the D flip-flop 354. D flip-flops 358-0 to 358-3 fetch the input data DI<0:3> based on the parameter clock signal D_CLK, and output the input data DI<0:3> as the parameter extraction signal INDA<0:3>.

The command extraction section 160 generates the command execution instruction signal EXECUTE in synchronization with the fetch timing of the parameter extraction signal INDA<0:3>. In FIG. 12, a signal set at the H level by a D flip-flop 360 at the rising edge of the signal output from the inversion data output terminal XQ of the D flip-flop 354 is synchronized with the dot clock signal CPH by a D flip-flop 362. The execution instruction signal EXECUTE is output as the detection pulse of the rising edge of the signal output from the D flip-flop 362. The execution instruction signal EXECUTE is output to the decoder 170. The D flip-flops 360 and 362 are initialized by the reset signal XRES. The D flip-flop 360 is initialized by an inversion signal of the execution instruction signal EXECUTE.

Figure 13:
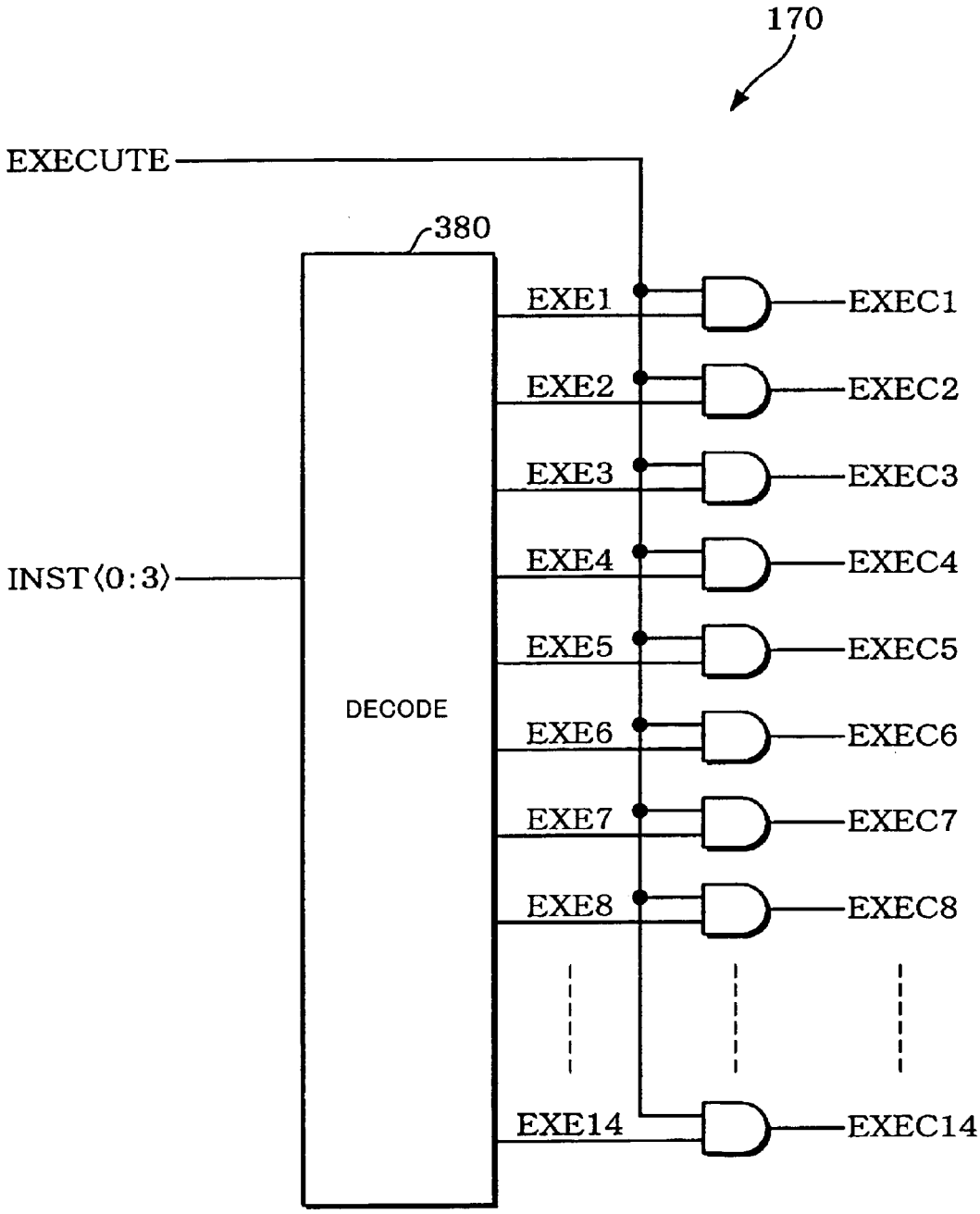
FIG. 13 shows a circuit configuration example of a decoder.

FIG. 13 shows a circuit configuration example of the decoder 170. The decoder 170 includes a decode circuit 380. The command extraction signal INST<0:3> is input to the decode circuit 380.

Figure 14:
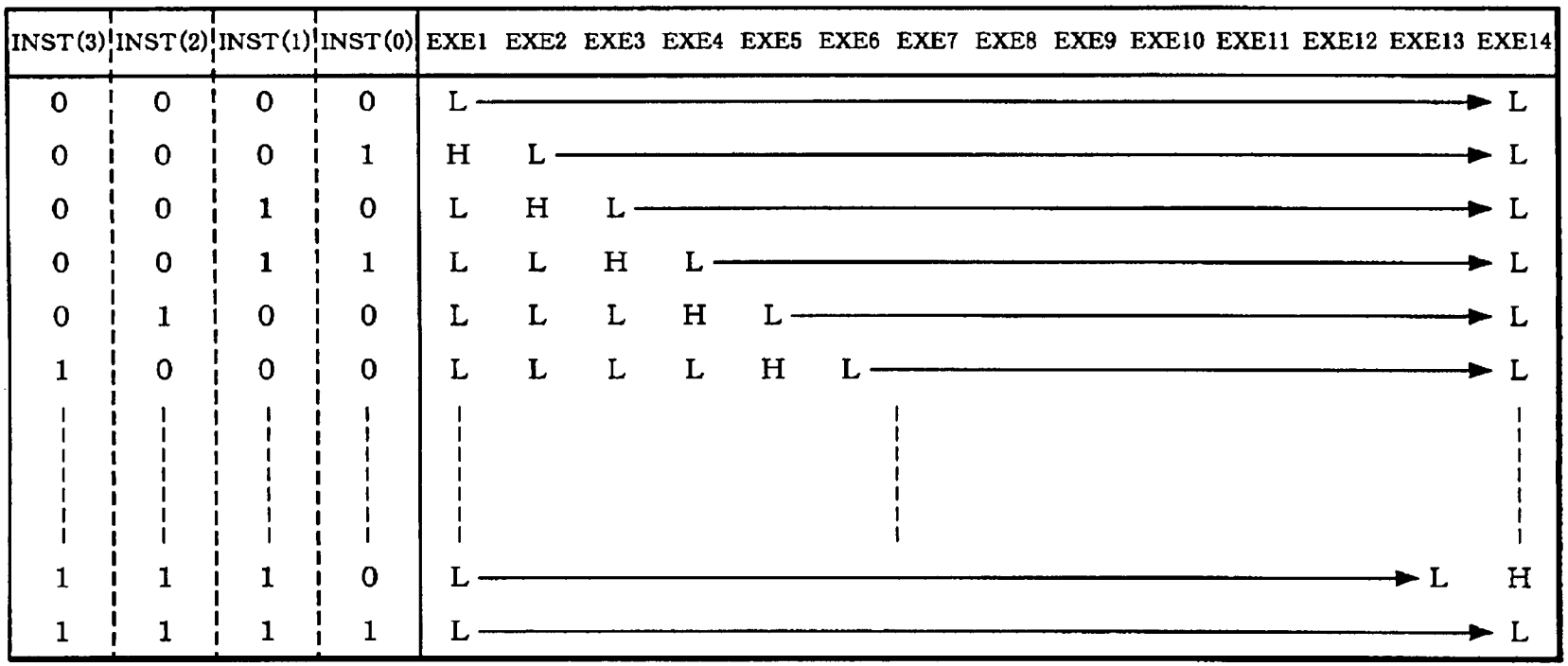
FIG. 14 shows a truth table of an operation example of a decode circuit.

FIG. 14 shows a truth table of an operation example of the decode circuit 380. The decode circuit 380 outputs register write signals EXE1 to EXE14, one of which is set at the H level corresponding to the command extraction signal INST<0:3>.

As shown in FIG. 13, each of the write instruction signals EXEC1 to EXEC14 is the AND operation result of each of the register write signals EXE1 to EXE14 from the decode circuit 380 and the execution instruction signal EXECUTE, respectively.

Figure 15:
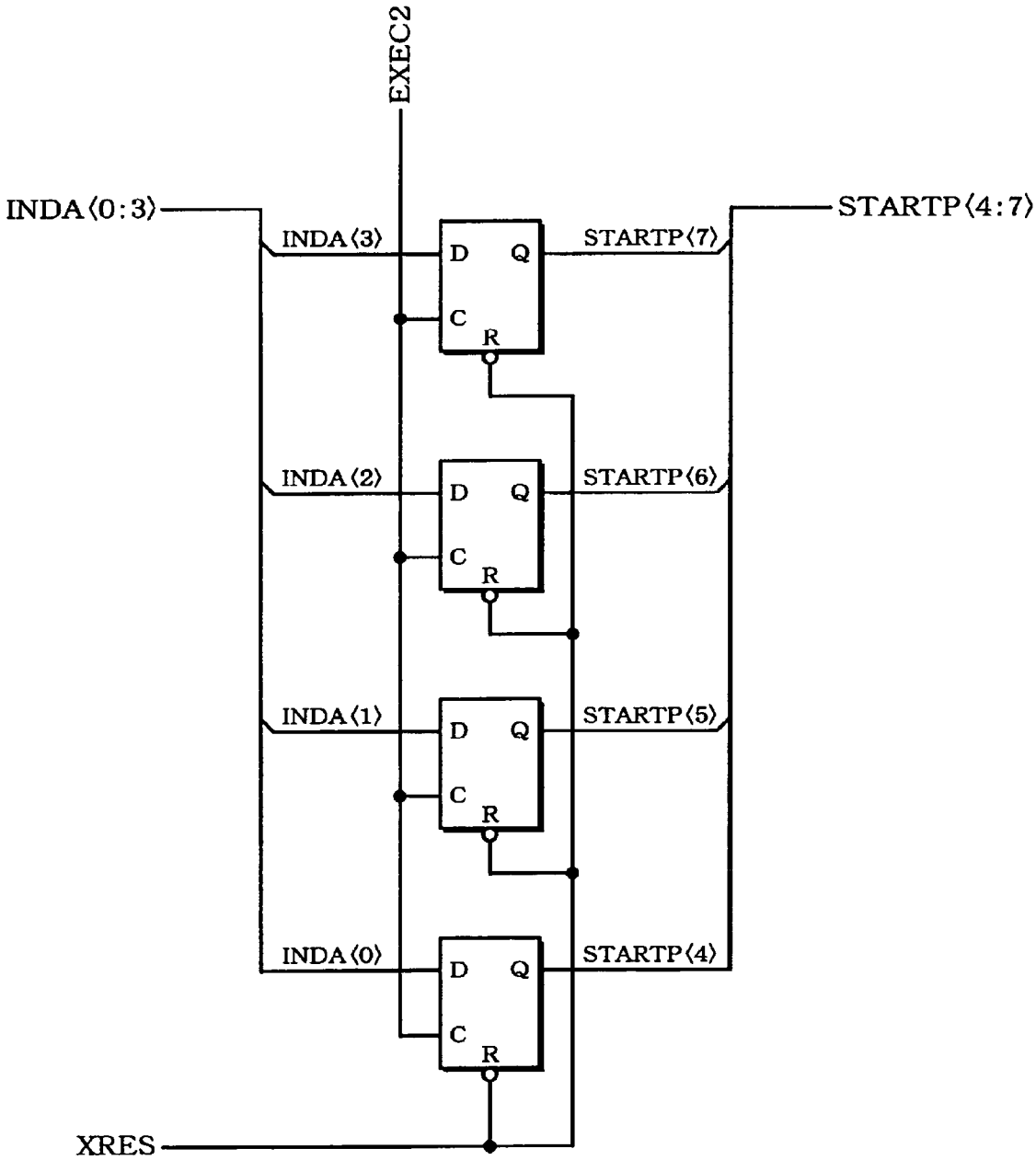
FIG. 15 shows a circuit configuration example of higher-order four bits of a command data start position setting register.

FIG. 15 shows a circuit configuration example of the higher-order four bits of the command data start position setting register 142-1. In FIG. 15, the parameter extraction signal INDA<0:3> is fetched at the rising edge of the write instruction signal EXEC2, and output as the start position signal STARTP<4:7>.

The configurations of the lower-order four bits of the command start position setting register 142-1, the higher-order four bits of the command end position setting register 142-2, the lower-order four bits of the command end position setting register 142-2, and the OPAMP output time setting register 144 are the same as the configuration of the higher-order four bits of the command data start position setting register 142-1 shown in FIG. 15. The write instruction signals EXEC3, EXEC4, EXEC5, and EXEC14 are respectively employed instead of the write instruction signal EXEC2. The start position signal STARTP<0:3>, the end position signal ENDP<4:7>, the end position signal ENDP<0:3>, and the output time setting signal VFcnt<0:3> are respectively employed instead of the start position signal STARTP<4:7>.

Only the least significant bit of the parameter extraction signal INDA <0:3> is used for the command signal switch register 142-3. In this case, the configuration of the command signal switch register 142-3 is the same as the configuration of the least significant bit of the higher-order four bits of the command data start position setting register 142-1. The write instruction signal EXEC1 is employed instead of the write instruction signal EXEC2. The select signal SEL is employed instead of the start position signal STARTP<4:7>.

Figure 17:
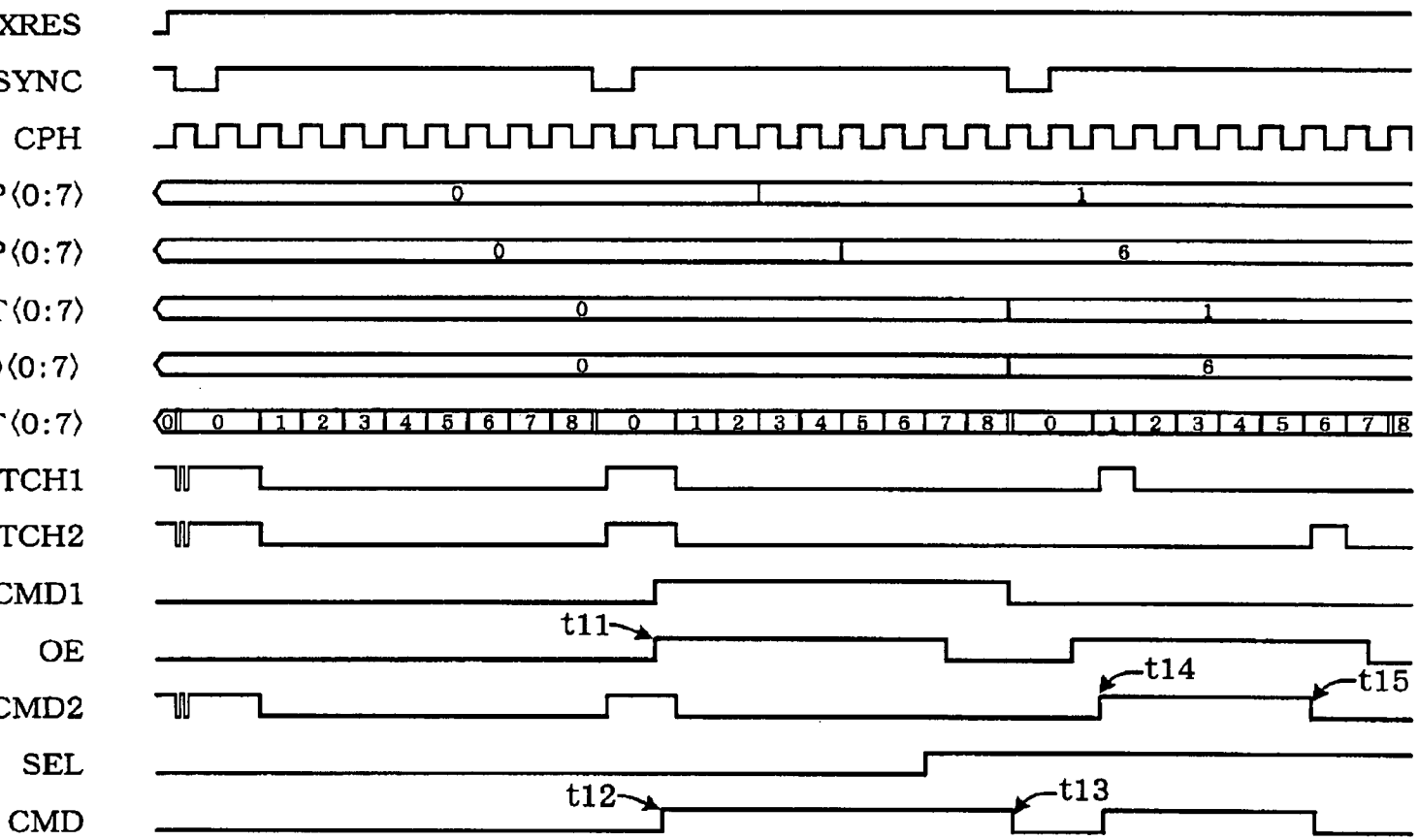
FIG. 17 is a timing diagram of an operation example of a command signal generation section shown in FIG. 8.
Figure 18:
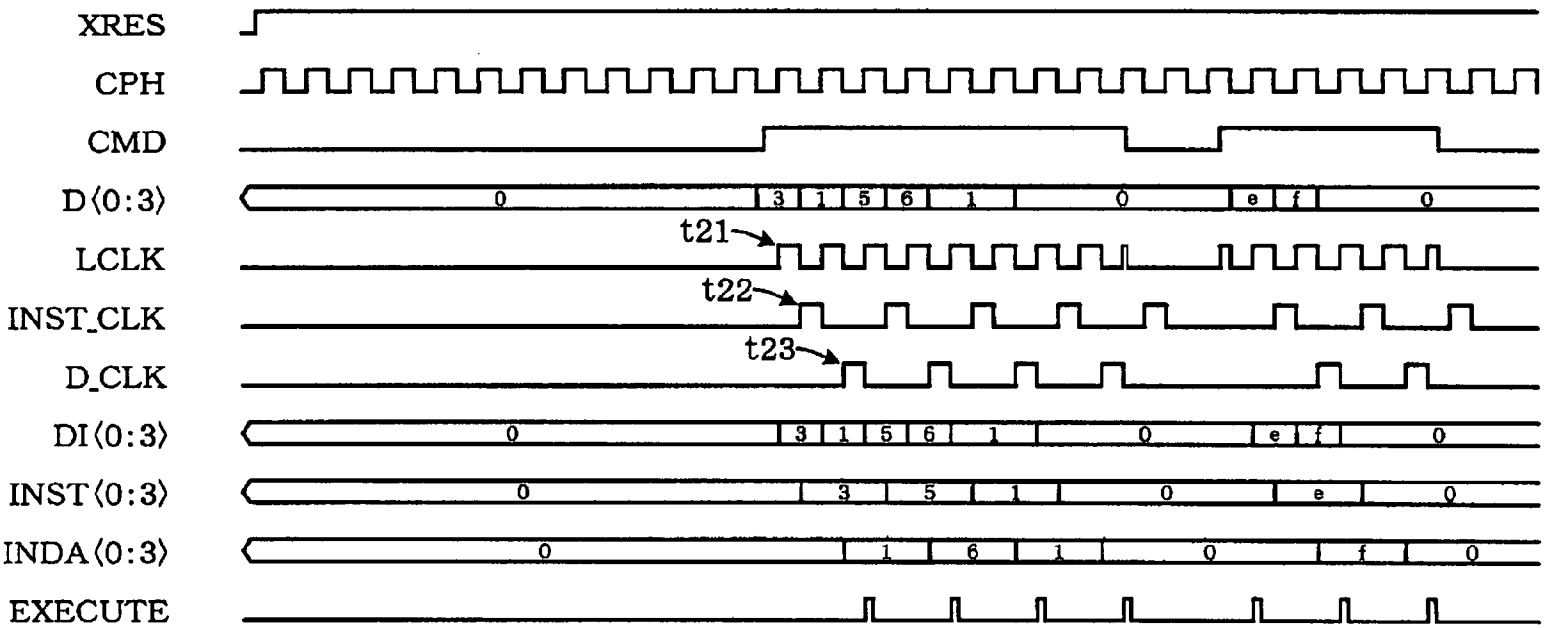
FIG. 18 is a timing diagram of an operation example of a command extraction section shown in FIG. 12.

The timing of an operation example of the above-described circuits is described below using FIGS. 16, 17, and 18. The timing waveform of each signal shown in FIGS. 16, 17, and 18 is the timing waveform on the same time axis.

In the following description, the first command data extracted by the first command signal output as the command signal includes command data for three commands. The three commands include a command which sets "1" in the lower-order four bits of the command data start position setting register 142-1, a command which sets "6" in the lower-order four bits of the command data end position setting register 142-2, and a command which sets "1" in the command signal switch register 142-3. In the command which sets "1" in the lower-order four bits of the command data start position setting register 142-1, the command section is "3" and the parameter section is "1". In the command which sets "6" in the lower-order four bits of the command data end position setting register 142-2, the command section is "5" and the parameter section is "6". In the command which sets "1" in the command signal switch register 142-3, the command section and the parameter section are respectively "1".

The second command data extracted by the second command signal output as the command signal is command data for a command which sets "15" in the OPAMP output time setting register 144. In the command data for the command which sets "15" in the OPAMP output time setting register 144, the command section is "14" ("e" in hexadecimal number system) and the parameter section is "15" ("f" in hexadecimal number system).

Figure 16:
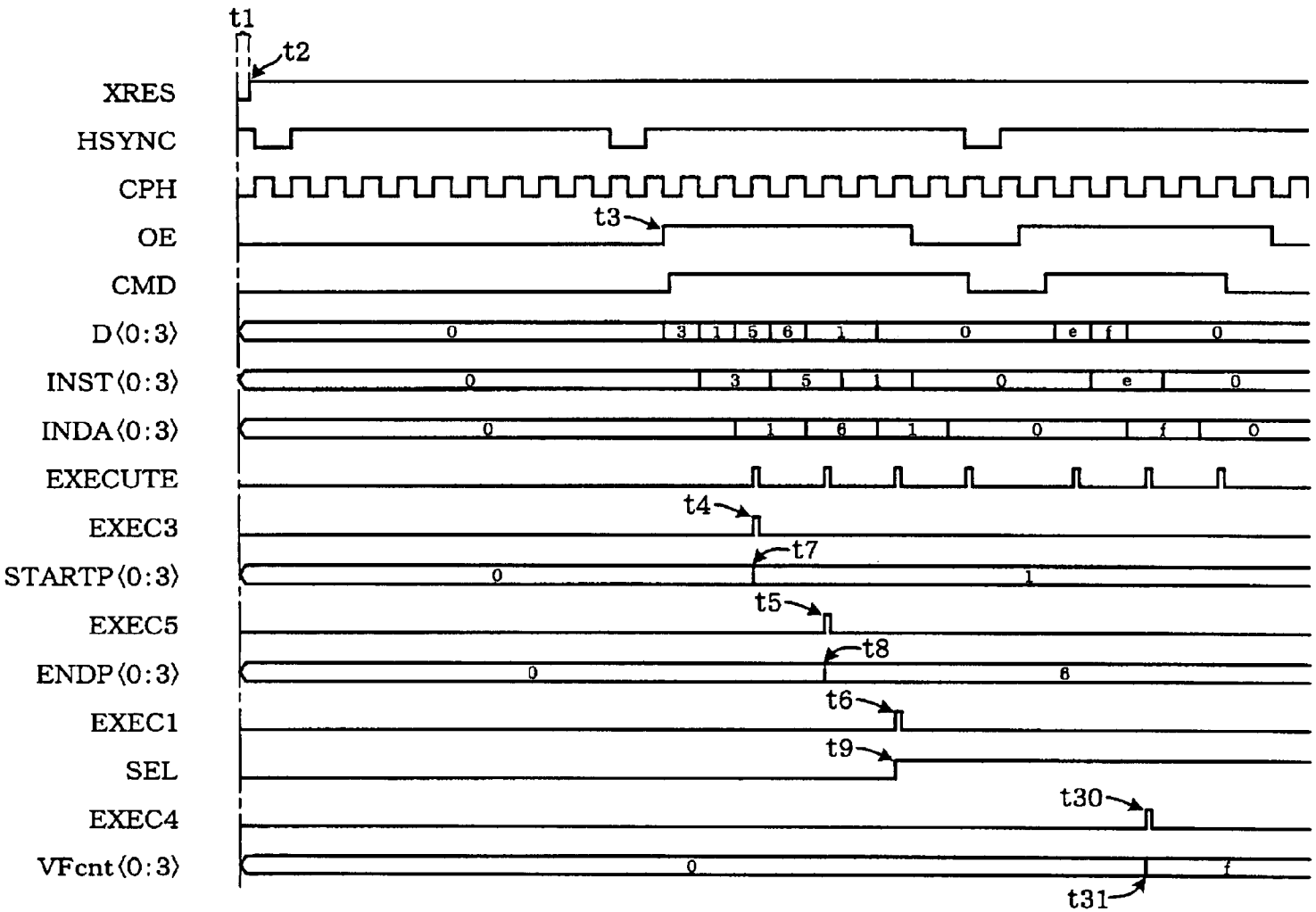
FIG. 16 is a timing diagram of an operation example of circuits shown in FIG. 7.

FIG. 16 shows a timing diagram of an operation example of the circuits shown in FIG. 7.

When the reset signal XRES supplied to the data driver 100 from the display controller is set at the L level (t1), each circuit shown in FIG. 7 is set in the initial state. The display controller then changes the reset signal XRES from the L level to the H level (t2) to change the horizontal synchronization signal HSYNC and the dot clock signal CPH. The horizontal scanning period starts when the horizontal synchronization signal HSYNC changes from the H level to the L level. The display controller changes the output enable signal OE from the H level to the L level in synchronization with the display timing (t3).

Since the select signal SEL is set at the L level in the initial state, the command signal generation section 150 outputs the first command signal CMD1 generated by the first command signal generation section 310 as the command signal CMD.

FIG. 17 shows a timing diagram of an operation example of the command signal generation section 150 shown in FIG. 8.

When the output enable signal OE changes to the H level (t11), the first command signal generation section 310 of the command signal generation section 150 generates the first command signal CMD1 at the H level. Therefore, the command signal CMD changes to the H level (t12). The first command signal CMD1 changes to the L level at the rising edge of the inversion horizontal synchronization signal XHSYNC (falling edge of the horizontal synchronization signal HSYNC) as shown in FIG. 8 (t13).

The command extraction section 160 extracts the first command data from the data on the input data bus 120 using the first command signal CMD1 as the command signal CMD.

In FIG. 16, the display controller outputs the command data for the above-described three commands when the output enable signal OE is set at the H level. In the data driver 100, the command data input through the data input section 110 is output to the input data bus 120.

FIG. 18 shows a timing diagram of an operation example of the command extraction section 160 shown in FIG. 12.

When the command signal CMD is set at the H level, the latch clock signal LCLK is output in synchronization with the dot clock signal CPH (t21).

The synchronization command signal DCMD is set at the H level by the D flip-flop 352. In a period in which the synchronization command signal DCMD is set at the H level, the command clock signal INST_CLK and the parameter clock signal D_CLK in reverse phase with the dot clock signal CPH are alternately output in a cycle twice the cycle of the dot clock signal CPH (t22 and t23).

The D flip-flops 350-0 to 350-3 fetch the data on the input data bus 120 in synchronization with the rising edge of the latch clock signal LCLK. The D flip-flops 356-0 to 356-3 fetch the input data DI<0:3> in synchronization with the rising edge of the command clock signal INST_CLK, and output the input data DI<0:3> as the command extraction signal INST<0:3>. The D flip-flops 358-0 to 358-3 fetch the input data DI<0:3> in synchronization with the rising edge of the parameter clock signal D_CLK, and output the input data DI<0:3> as the parameter extraction signal INDA<0:3>. The command extraction section 160 outputs the execution instruction signal EXECUTE as shown in FIG. 12.

The decoder 170 decodes the command extraction signal INST<0:3> according to the truth table shown in FIG. 14, and sets the value of the parameter extraction signal INDA<0:3> in the control register specified by the command extraction signal INST<0:3> based on the pulse of the execution instruction signal EXECUTE.

In FIGS. 16 and 18, the write instruction signals EXEC3, EXEC5, and EXEC1 become active in that order (t4, t5, t6). As a result, "1" (INDA<0:3>=1) is set in the lower-order four bits of the command data start position setting register 142-1 (INST<0:3>=3) (t7). "6" (INDA<0:3>=6) is set in the lower-order four bits of the command data end position setting register 142-2 (INST<0:3>=5) (t8). "1" (INDA<0:3>=1) is set in the command signal switch register 142-3 (INST<0:3>=1) (t9). When "1" is set in the command signal switch register 142-3, the select signal SEL is set at the H level.

When the select signal SEL is set at the H level, the command signal generation section 150 outputs the second command signal CMD2 generated by the second command signal generation section 320 as the command signal CMD.

As shown in FIG. 17, the counter 326 of the second command signal generation section 320 counts the number of dot clock signals CPH in a period in which the horizontal synchronization signal HSYNC is set at the H level. The start position synchronization signal START<0:7> and the end position synchronization signal END<0:7> are updated at the falling edge of the horizontal synchronization signal HSYNC.

Therefore, in the horizontal scanning period subsequent to the horizontal scanning period in which the first command data is input, the comparators 328 and 330 respectively compare the start position synchronization signal START<0:7> and the end position synchronization signal END<0:7> with the counter value COUNT<0:7> of the counter 326. When the comparator 328 determines that the start position synchronization signal START<0:7> coincides with the counter value COUNT<0:7>, the first coincidence detection signal MATCH1 is set at the H level. When the comparator 330 determines that the end position synchronization signal END<0:7> coincides with the counter value COUNT<0:7>, the second coincidence detection signal MATCH2 is set at the H level.

The second command signal CMD2 is set at the H level when the first coincidence detection signal MATCH1 is set at the H level (t14), and the second command signal CMD2 is set at the L level when the second coincidence detection signal MATCH2 is set at the H level (t15). Therefore, the second command signal of which the logical level changes when a period corresponding to the start position of the command data has elapsed and a period corresponding to the end position of the command data has elapsed based on the horizontal synchronization signal HSYNC (based on given timing) can be generated. As a result, the command signal CMD is set at the H level for a period between a time at which the counter value COUNT<0:7> changes to "1" (t14) and a time at which the counter value COUNT<0:7> changes to "6" (t15).

As shown in FIG. 5B, the second command signal of which the logical level changes when a period corresponding to the length of the display data has elapsed based on the horizontal synchronization signal HSYNC (based on given timing) may also be generated. For example, the second command signal, which is set at the L level at the falling edge of the horizontal synchronization signal HSYNC, is set at the H level when the counter value COUNT<0:7> becomes the value corresponding to the length of the display data.

In FIG. 16, in the horizontal scanning period subsequent to the horizontal scanning period in which the first command data is input, the display controller outputs the command data for the command which sets "15" in the OPAMP output time setting register 144. In more detail, the display controller outputs the command data subsequent to the display data at a timing set by the first command data.

This enables the data driver 100 to correctly fetch the command data on the input data bus 120 by the second command signal CMD2 output as the command signal CMD. In this case, the write instruction signal EXEC14 becomes active by the command extraction signal INST<0:3> extracted by the command extraction section 160 as shown in FIG. 16 (t30). "15" (INDA<0:3>=15) is set in the OPAMP output time setting register 144 (INST<0:3>=14) (t31).

According to this embodiment, the setting by the command data is enabled merely by designating the timing at which the command signal becomes active corresponding to the length of the display data, whereby an input terminal for the signal for identifying the command data or the display data can be made unnecessary.

A configuration example of the display processing section 130 controlled based on the command data is described below. The following description illustrates a configuration example in the case where the data line driver section 250 of the display processing section 130 is controlled based on the value set in the OPAMP output time setting register 144.

Figure 19:
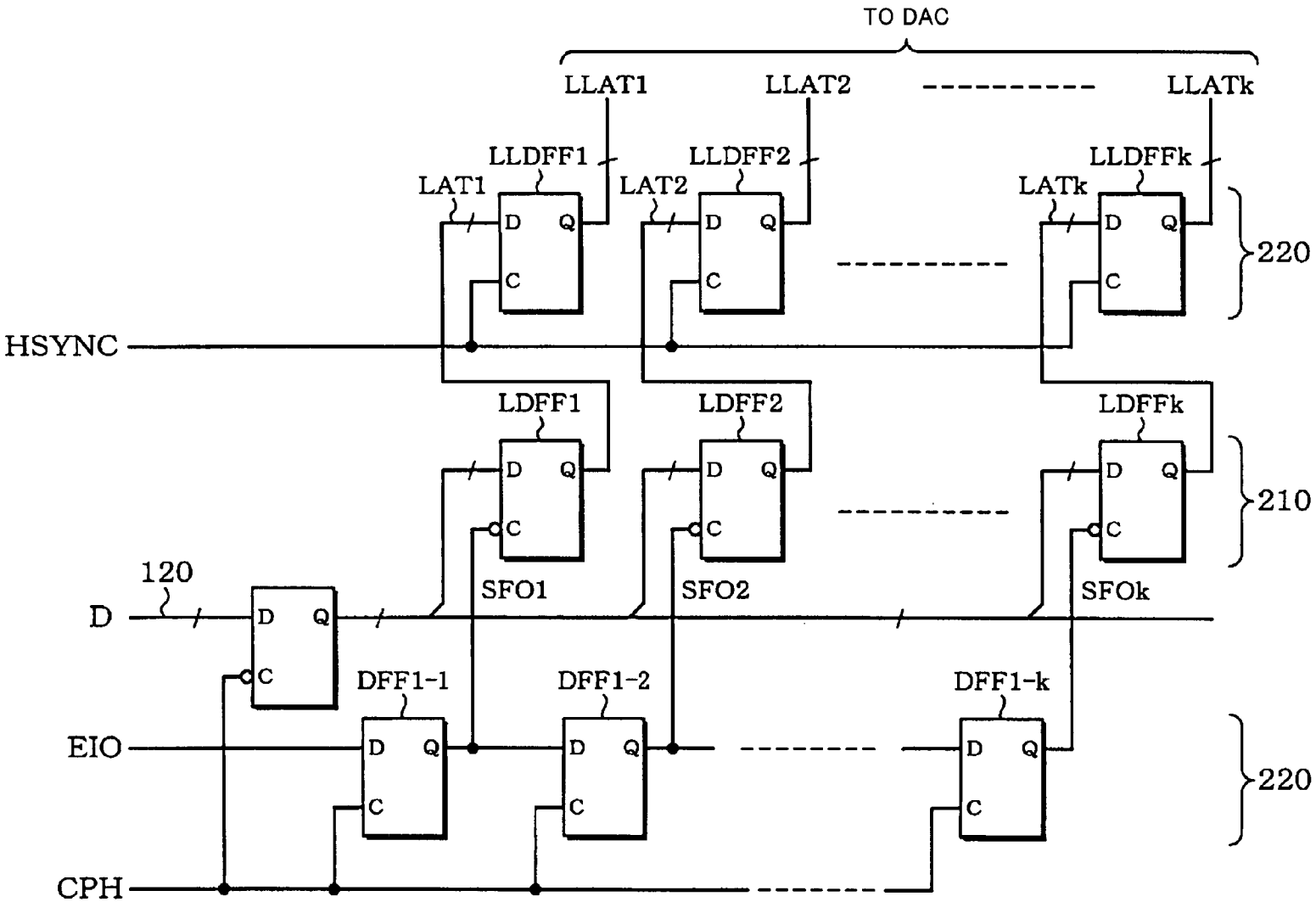
FIG. 19 shows a circuit configuration example of a shift register, a data latch, and a line latch.

FIG. 19 shows a circuit configuration example of the shift register 200, the data latch 210, and the line latch 220.

The shift register 200 includes first to k-th D flip-flops DFF1-1 to DFF1-k. In the following description, the i-th D flip-flop (1≦i≦k, i is an integer) is denoted as the D flip-flop DFF1-i. The shift register 200 is formed by connecting the D flip-flops DFF1-1 to DFF1-k in series. Specifically, a data output terminal Q of the D flip-flop DFF1-j (1≦j≦k−1, j is an integer) is connected with a data input terminal D of the D flip-flop DFF1-(j+1) in the subsequent stage.

Shift outputs SFO1 to SFOk are output from the data output terminals Q of the D flip-flops DFF1-1 to DFF1-k. The enable input/output signal EIO is input to the data input terminal D of the D flip-flop DFF1-1. The dot clock signal CPH is input in common to the clock input terminals C of the D flip-flops DFF1-1 to DFF1-k.

The data latch 210 includes first to k-th latch D flip-flops. In the following description, the i-th latch D flip-flop (1≦i≦k, i is an integer) is denoted as the D flip-flop LDFFi. The D flip-flop LDFFi retains a signal input to a data input terminal D at the falling edge of a signal input to a clock input terminal C. The D flip-flop LDFFi retains the display data for the number of bits of the bus width of the input data bus 120. The shift output SFOi from the shift register 200 is supplied to the clock input terminal C of the D flip-flop LDFFi. Latch data LATi is data from the data output terminal Q of the D flip-flop LDFFi. The input synchronization data generated by synchronizing the data on the input data bus 120 (display data in a narrow sense) with the falling edge of the dot clock signal CPH is input in common to the data input terminals D of the D flip-flops LDFF1 to LDFFk.

The line latch 220 includes first to k-th line latch D flip-flops. In the following description, the i-th line latch D flip-flop (1≦i≦k, i is an integer) is denoted as the D flip-flop LLDFFi. The line latch D flip-flop retains the display data for the number of bits of the bus width of the input data bus 120. The horizontal synchronization signal HSYNC is supplied to the clock input terminal C of the D flip-flop LLDFFi. Line latch data LLATi is data from a data output terminal Q of the D flip-flop LLDFFi. The data output terminal Q of the D flip-flop LDFFi is connected with a data input terminal D of the D flip-flop LLDFFi.

The D flip-flops DFF1-1 to DFF1-k, LDFF1 to LDFFk, and LLDFF1 to LLDFFk are initialized by the reset signal XRES.

Figure 20:
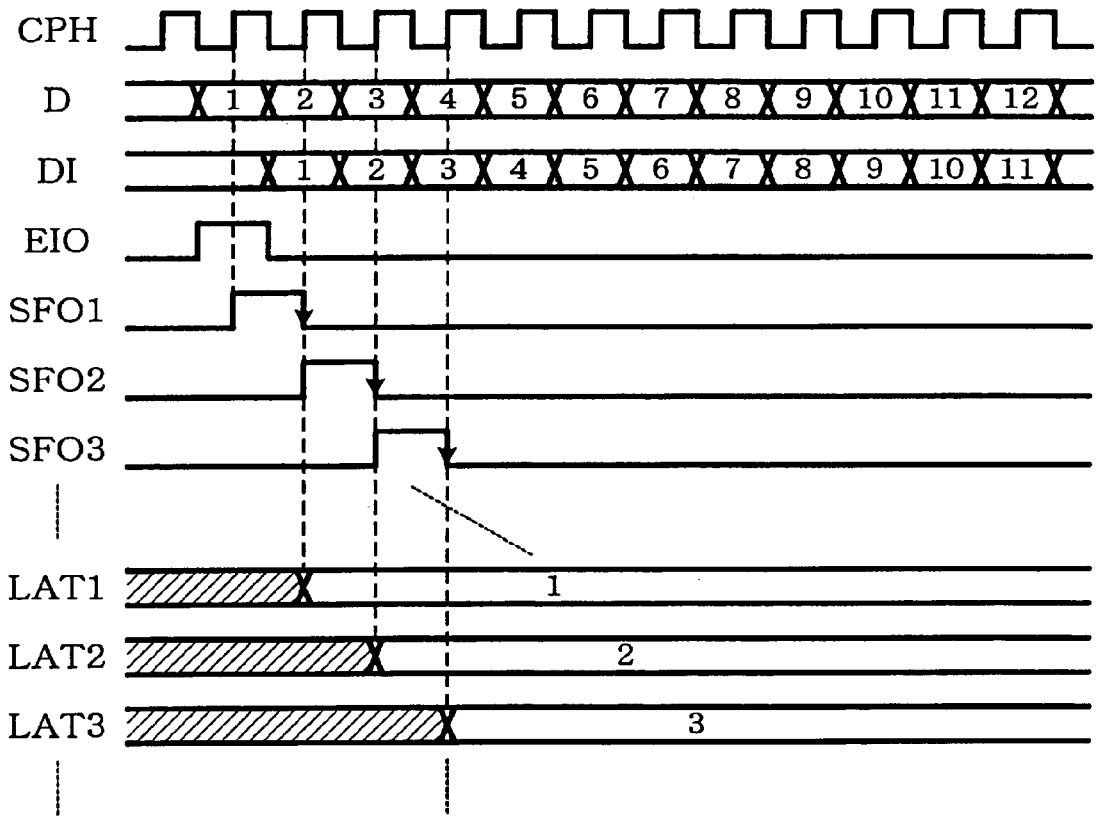
FIG. 20 is a timing diagram of an operation example of a shift register and a data latch.

FIG. 20 shows a timing diagram of an operation example of the shift register 200 and the data latch 210.

The display data is sequentially supplied to the data bus in pixel units in synchronization with the dot clock signal CPH. The enable input/output signal EIO is set at the H level corresponding to the head position of the display data.

The shift register 200 performs the shift operation of the enable input/output signal EIO. Specifically, the shift register 200 fetches the enable input/output signal EIO at the rising edge of the dot clock signal CPH. The shift register 200 sequentially outputs a pulse shifted in synchronization with the rising edge of the dot clock signal CPH as the shift outputs SFO1 to SFOk in each stage.

The data latch 210 fetches the input synchronization data as the display data at the falling edge of the shift output in each stage of the shift register 200. As a result, the data latch 210 fetches the display data in the order of the D flip-flops LDFF1, LDFF2, . . . . The display data fetched into the D flip-flops LDFF1 to LDFFk is respectively output as the latch data LAT1 to LATk.

The line latch 220 latches the display data fetched into the data latch 210 in units of one horizontal scanning period. The display data for one horizontal scan latched by the line latch 220 is supplied to the DAC 230.

Figure 21:
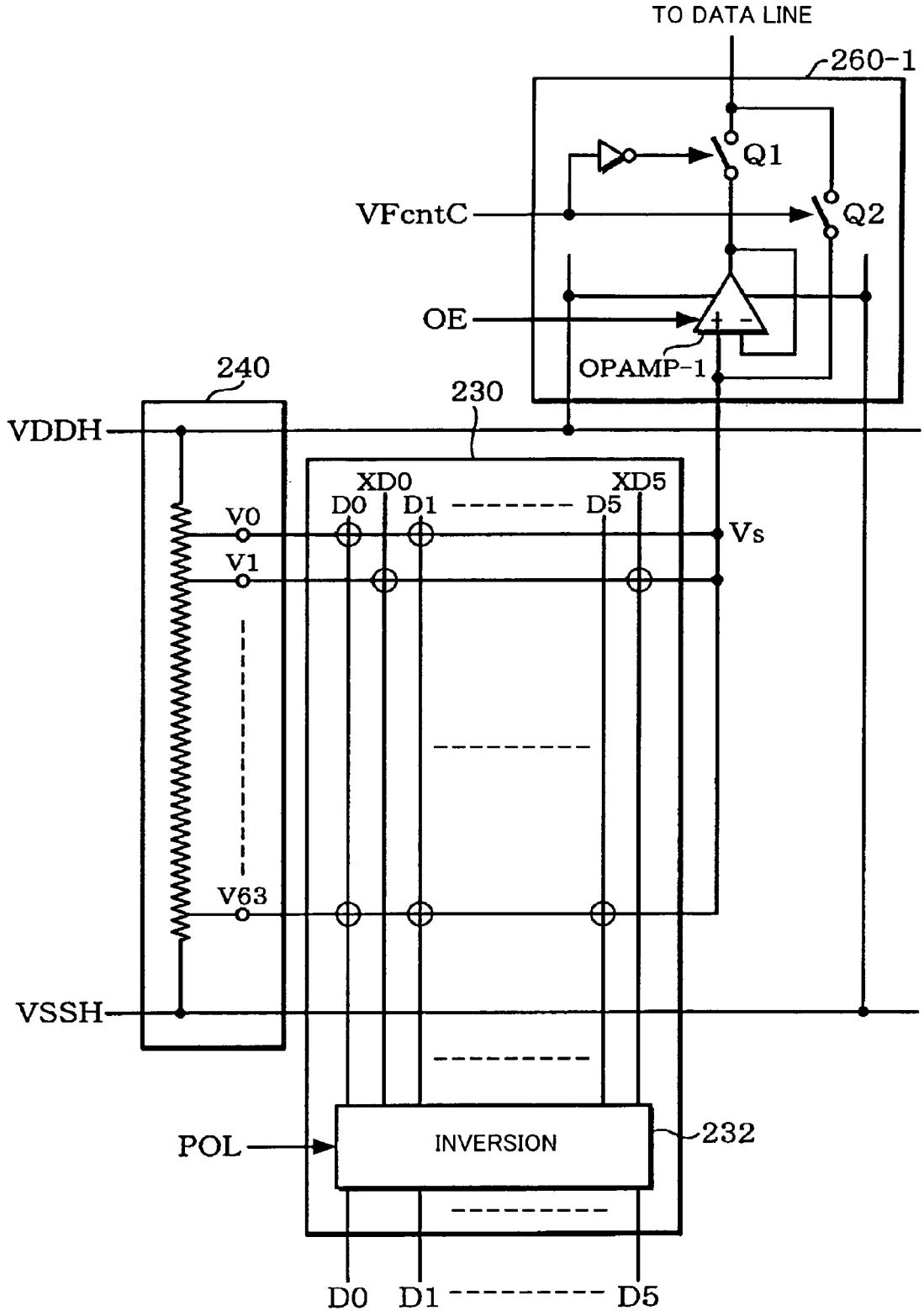
FIG. 21 shows a circuit configuration example of a DAC, a reference voltage generation circuit, and one data output section of a data line driver section.

FIG. 21 shows a circuit configuration example of the DAC 230, the reference voltage generation circuit 240, and one data output section of the data line driver section 250. FIG. 21 shows only the configuration for one output.

The reference voltage generation circuit 240 supplies a plurality of reference voltages to the DAC 230. The reference voltage generation circuit 240 includes a resistor circuit inserted between two power supply lines to which high-potential-side and low-potential-side power supply voltages are supplied, and generates the reference voltages by dividing the voltage between the two power supply lines using the resistor circuit.

The DAC 230 may be realized by a read only memory (ROM) decode circuit. The DAC 230 selects one of the reference voltages based on 6-bit display data (display data for one dot), and outputs the selected reference voltage to the data output section 260 (data output section 260-1 in FIG. 21) as a select voltage Vs.

In more detail, the DAC 230 includes an inversion circuit 232 which reverses 6-bit display data D0 to D5 based on a polarity reversal signal POL. The inversion circuit 232 performs non-inversion output of each bit of the display data when the polarity reversal signal POL is set at a first logical level. The inversion circuit 232 performs inversion output of each bit of the display data when the polarity reversal signal POL is set at a second logical level. The output from the inversion circuit 232 is input to a ROM decoder.

The DAC230 selects one of the reference voltages generated by the reference voltage generation circuit 240 based on the output from the inversion circuit 232.

The select voltage Vs selected by the DAC 230 is input to the data output section 260-1. The data line driver section 250 includes data output sections provided in data line units. Each data output section has the same configuration as that of the data output section 260-1.

The data output section 260-1 includes an operational amplifier circuit OPAMP and switch circuits Q1 and Q2. The operational amplifier circuit OPAMP is a voltage-follower-connected operational amplifier. The operational amplifier circuit OPAMP is output-controlled by the output enable signal OE. An operating current source of the operational amplifier is turned OFF when the output enable signal OE is set at the H level, whereby the output of the operational amplifier circuit OPAMP is set in a high impedance state. The operating current source of the operational amplifier is turned ON when the output enable signal OE is set at the L level, and the operational amplifier circuit OPAMP drives the data line based on the select voltage Vs.

A control signal VFcntC for ON/OFF controlling the switch circuits Q1 and Q2 is input to the data output section 260-1. The control signal VFcntC is generated by the control section 140. The control section 140 generates the control signal VFcntC based on an output time setting signal VFcnt<0:3> as a control signal. The output time setting signal VFcnt<0:3> is a control signal corresponding to the value set in the OPAMP output time setting register 144 shown in FIG. 6. In more detail, the control section 140 generates the control signal VFcntC of which the logical level changes from the L level to the H level after a period for the number of dot clock signals CPH corresponding to the value of the output time setting signal VFcnt<0:3> has elapsed based on the time at which the horizontal synchronization signal HSYNC changes from the L level to the H level. The control section 140 may include a plurality of OPAMP output time setting registers in which different values can be set, and generate the control signal VFcntC in units of one or more data output sections.

The switch circuit Q2 is ON/OFF controlled by the control signal VFcntC. The switch circuit Q1 is ON/OFF controlled by an inversion signal of the control signal VFcntC. The ON/OFF control by the control signal VFcntC is enabled when the output enable signal OE is set at the L level.

Figure 22:
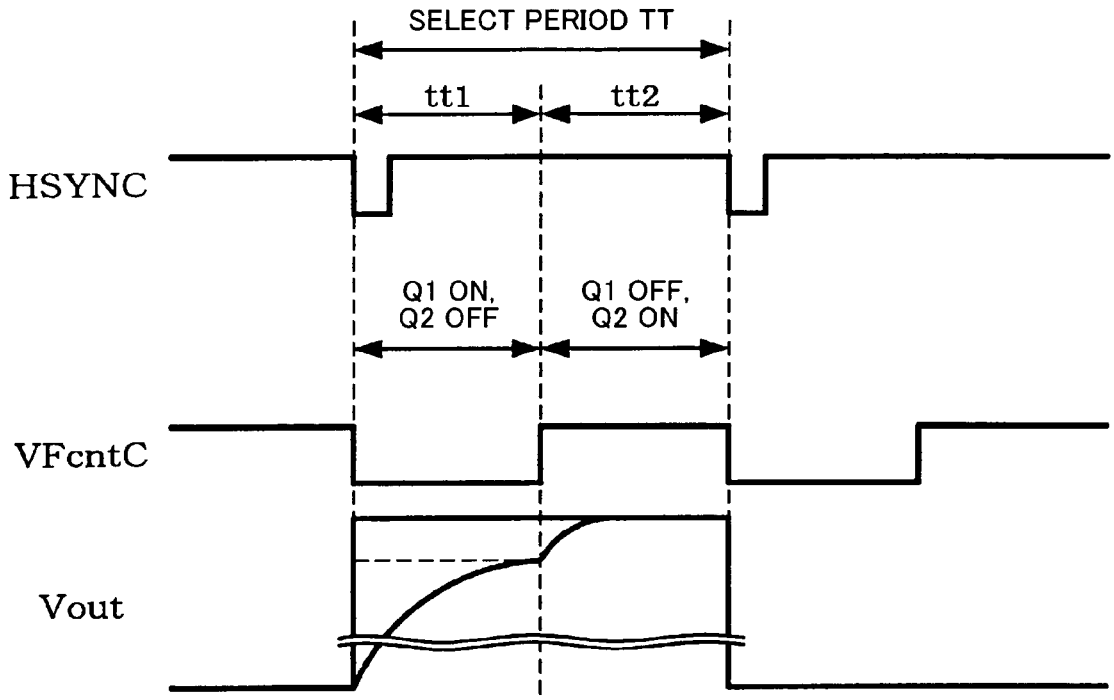
FIG. 22 shows an example of operation timing of a data output section.

FIG. 22 shows an example of operation timing of the data output section 260-1.

The control signal VFcntC changes from the L level to the H level after a period corresponding to the value set in the OPAMP output time setting register 144 has elapsed in a select period (drive period) TT specified by the horizontal synchronization signal HSYNC. Specifically, the logical level of the control signal VFcntC changes in a first period tt1 (first given period of drive period) and a second period tt2 of the select period TT, as shown in FIG. 22. The switch circuit Q1 is turned ON and the switch circuit Q2 is turned OFF when the control signal VFcntC is set at the L level in the first period tt1. The switch circuit Q1 is turned OFF and the switch circuit Q2 is turned ON when the control signal VFcntC is set at the H level in the second period tt2. Therefore, in the select period TT, the data line is driven by the operational amplifier circuit OPAMP through impedance conversion in the first period tt1, and the data line is driven using the select voltage Vs output from the DAC 230 in the second period tt2.

This enables a drive voltage Vout to be raised at high speed by the voltage-follower-connected operational amplifier OPAMP having high drive capability in the first period tt1 necessary for charging a liquid crystal capacitance, interconnect capacitance, and the like, and enables the drive voltage to be output by the DAC 230 in the second period tt2 in which high drive capability is unnecessary. Therefore, power consumption can be reduced by minimizing the operation period of the operational amplifier circuit OPAMP which consumes a large amount of current, and occurrence of a problem in which the select period TT is decreased due to an increase in the number of data lines to cause the charge period to become insufficient can be prevented.

As described above, in this embodiment, the display processing section 130 can be controlled based on the value set in the control register 142. The display controller can set a value in the control register 142 using the command data as described above.

3. Electro-Optical Device

An electro-optical device including a data driver to which the display driver in this embodiment is applied is described below.

Figure 23:
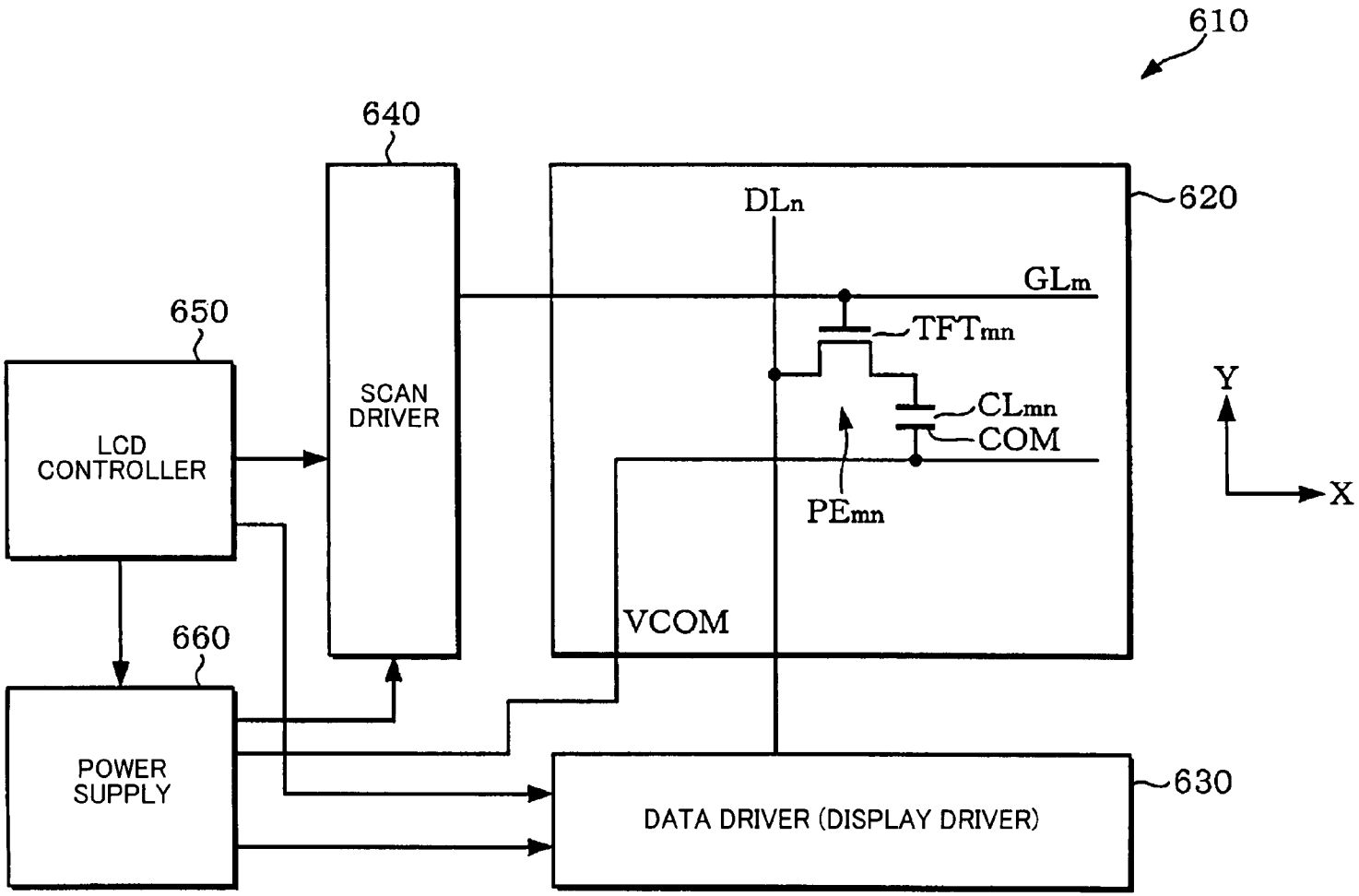
FIG. 23 shows a configuration example of an electro-optical device in an embodiment of the present invention.

FIG. 23 is a configuration diagram showing a configuration example of an electro-optical device in this embodiment. The following description is given taking a liquid crystal device as an example of an electro-optical device.

An electro-optical device may be incorporated into various electronic instruments such as a portable telephone, portable information instrument (PDA or the like), digital camera, projector, portable audio player, mass storage device, video camera, electronic notebook, or global positioning system (GPS).

In FIG. 23, an electro-optical device 610 includes a liquid crystal display (LCD) panel 620 (display panel or electro-optical panel in a broad sense), a data driver 630, a scan driver 640 (gate driver), and an LCD controller 650 (display controller in a broad sense). The data driver 630 includes the function of the data driver 10 in this embodiment.

The electro-optical device 610 does not necessarily include all of these circuit blocks. The electro-optical device 610 may have a configuration in which some of the circuit blocks are omitted.

The LCD panel 620 includes a plurality of scan lines (gate lines), each of the scan lines being provided in one of rows, a plurality of data lines (source lines) which intersect the scan lines, each of the data lines being provided in one of columns, and a plurality of pixels, each of the pixels being specified by one of the scan lines and one of the data lines. Each pixel includes a thin-film transistor (hereinafter abbreviated as "TFT") and a pixel electrode. The TFT is connected with the data line, and the pixel electrode is connected with the TFT.

In more detail, the LCD panel 620 is formed on a panel substrate such as a glass substrate. A plurality of scan lines GL1 to GLM (M is an integer of two or more; M is preferably three or more), arranged in the Y direction shown in FIG. 23 and extending in the X direction, and a plurality of data lines DL1 to DLN (N is an integer of two or more), arranged in the X direction and extending in the Y direction, are disposed on the panel substrate. The pixel PEmn is provided at a position corresponding to the intersecting point of the scan line GLm ($1 \leqq m \leqq M$, m is an integer) and the data line DLn ($1 \leqq n \leqq N$, n is an integer). The pixel PEmn includes the thin-film transistor TFTmn and the pixel electrode.

A gate electrode of the thin-film transistor TFTmn is connected with the scan line GLm. A source electrode of the thin-film transistor TFTmn is connected with the data line DLn. A drain electrode of the thin-film transistor TFTmn is connected with the pixel electrode. A liquid crystal capacitor CLmn is formed between the pixel electrode and a common electrode COM which faces the pixel electrode through a liquid crystal element (electro-optical material in a broad sense). A storage capacitor may be formed in parallel with the liquid crystal capacitor CLmn. The transmissivity of the pixel changes corresponding to the voltage applied between the pixel electrode and the common electrode COM. A voltage VCOM supplied to the common electrode COM is generated by the power supply circuit 660.

The LCD panel 620 is formed by attaching a first substrate on which the pixel electrode and the TFT are formed to a second substrate on which the common electrode is formed, and sealing a liquid crystal as an electro-optical material between the two substrates, for example.

The data driver 630 drives the data lines DL1 to DLN of the LCD panel 620 based on display data for one horizontal scan. In more detail, the data driver 630 drives at least one of the data lines DL1 to DLN based on the display data.

The scan driver 640 scans the scan lines GL1 to GLM of the LCD panel 620. In more detail, the scan driver 640 sequentially selects the scan lines GL1 to GLM in one vertical scanning period, and drives the selected scan line.

The LCD controller 650 outputs control signals to the scan driver 640, the data driver 630, and the power supply circuit 660 according to the content set by a host such as a CPU (not shown). In more detail, after the LCD controller 650 is initialized, the LCD controller 650 initializes the data driver 630 and the scan driver 640. In this case, the LCD controller 650 outputs the reset signal XRES to the data driver 630, and supplies the first command data to the data driver 630. The LCD controller 650 then supplies the horizontal synchronization signal HSYNC or the vertical synchronization signal VSYNC generated therein, the dot clock signal CPH, and the display data, and performs an operation mode setting using the command data (second command data). The LCD controller 650 controls the power supply circuit 660 relating to polarity reversal timing of the voltage VCOM applied to the common electrode COM using the polarity reversal signal POL.

The power supply circuit 660 generates various voltages supplied to the scan driver 640 and the voltage VCOM applied to the common electrode COM based on the reference voltage supplied from the outside.

In FIG. 23, the electro-optical device 610 is configured to include the LCD controller 650. However, the LCD controller 650 may be provided outside the electro-optical device 610. The host (not shown) may be included in the electro-optical device 610 together with the LCD controller 650.

At least one of the scan driver 640 and the LCD controller 650 may be included in the data driver 630.

Some or all of the data driver 630, the scan driver 640, and the LCD controller 650 may be formed on the LCD panel 620. The data driver 630 and the scan driver 640 may be formed on a panel substrate on which the LCD panel 620 is formed, for example. The LCD panel 620 may be configured to include a plurality of data lines, a plurality of scan lines, a plurality of pixels, each of the pixels being specified by one of the data lines and one of the scan lines, and a data driver which drives the data lines. The pixels are formed in a pixel formation region of the LCD panel 620.

In this electro-optical device, the size and power consumption can be further reduced by incorporating the data driver in this embodiment.

The present invention is not limited to the above-described embodiment. Various modifications and variations are possible within the spirit and scope of the present invention. For example, the present invention may be applied not only to drive the liquid crystal display panel, but also to drive an electroluminescent or plasma display device.

This embodiment illustrates an example in which the data line driver section is controlled by the value set in the control register. However, the present invention is not limited thereto. For example, the present invention may be applied to control based on the command data identified from the command data and the display data by a signal which has been input through the input terminal such as a signal for output selection of the data output section, selection of a partial block, or selection of the resistor circuit of the reference voltage generation circuit.

Part of requirements of any claim of the present invention could be omitted from a dependent claim which depends on that claim. Moreover, part of requirements of any independent claim of the present invention could be made to depend on any other independent claim.

What is claimed is:

1. A display driver that drives a plurality of data lines of an electro-optical panel that includes a plurality of scan lines, the plurality of data lines, and a plurality of pixels, the display driver comprising:

a data input section to which display data or command data is input;

a control register that is used for controlling a display processing section;

a command signal generation section that outputs a first or second command signal that is used to identify the command data, including:

a first command signal generation section that generates the first command signal that changes at a predetermined timing, and a second command signal generation section that generates the second command signal that changes based on a value set in the control register corresponding to a decoding result of first command data, the first command data comprising command data extracted based on the first command signal;

a command extraction section that extracts the command data from data including the display data or the command data input through the data input section based on the output first or second command signal;

a decoder that decodes the command data extracted by the command extraction section; and the display processing section including a data line driver section that drives the data lines based on the display data input through the data input section and controlled based on a value set in the control register corresponding to a decoding result of the command data extracted based on the output second command signal.

2. The display driver as defined in claim 1, the first command data including command data that sets a select flag for selecting one of the first and second command signals in the control register, and the command signal generation section outputting the first or second command signal based on the select flag.

3. The display driver as defined in claim 1, the first command data including command data that designates a start position and an end position of next command data, and the second command signal generation section generating the second command signal of which a logical level changes when a period corresponding to the start position of the next command data has elapsed based on a given timing and a period corresponding to the end position of the next command data has elapsed based on the given timing.

4. The display driver as defined in claim 2, the first command data including command data that designates a start position and an end position of next command data, and the second command signal generation section generating the second command signal of which a logical level changes when a period corresponding to the start position of the next command data has elapsed based on a given timing and a period corresponding to the end position of the next command data has elapsed based on the given timing.

5. The display driver as defined in claim 1, the first command data including command data that designates a length of the display data, and the second command signal generation section generating the second command signal of which a logical level changes when a period corresponding to the length of the display data has elapsed based on a given timing.

6. The display driver as defined in claim 2, the first command data including command data that designates a length of the display data, and the second command signal generation section generating the second command signal of which a logical level changes when a period corresponding to the length of the display data has elapsed based on a given timing.

7. An electro-optical device comprising:

a plurality of scan lines;

a plurality of data lines;

a plurality of pixels; and the display driver as defined in claim 1 that drives the plurality of data lines.

8. An electro-optical device comprising:

a plurality of scan lines;

a plurality of data lines;

a plurality of pixels; and the display driver as defined in claim 2 that drives the plurality of data lines.

9. An electro-optical device comprising:

a plurality of scan lines;

a plurality of data lines;

a plurality of pixels; and the display driver as defined in claim 3 that drives the plurality of data lines.

10. An electro-optical device comprising:

a plurality of scan lines;

a plurality of data lines;

a plurality of pixels; and the display driver as defined in claim 4 that drives the data lines.

11. An electro-optical device comprising:

a plurality of scan lines;

a plurality of data lines;

a plurality of pixels; and the display driver as defined in claim 5 that drives the data lines.

12. An electro-optical device comprising:

a plurality of scan lines;

a plurality of data lines;

a plurality of pixels; and the display driver as defined in claim 6 that drives the plurality of data lines.

13. A control method for a display driver that drives a plurality of data lines of an electro-optical panel that includes a plurality of scan lines, the plurality of data lines, and a plurality of pixels, the control method comprising:

generating a command signal that is used to identify command data;

extracting the command data from display data or command data input through a data input section based on the command signal;

setting a value corresponding to a decoding result of the extracted command data in a control register;

controlling a display processing section that includes a data line driver section, that drives the data lines based on the display data input through the data input section, based on the value set in the control register;

generating a first command signal that changes at a predetermined timing;

extracting first command data from the display data or the command data input through the data input section based on the first command signal;

setting a value corresponding to a decoding result of the first command data in the control register;

generating a second command signal that changes based on the value set in the control register in which the value corresponding to the decoding result of the first command data is set;

extracting second command data from the display data or the command data input through the data input section based on the first command signal;

setting a value corresponding to a decoding result of the second command data in the control register; and controlling the display processing section based on the value set in the control register in which the value corresponding to the decoding result of the second command data is set.

* * * * *